US005314390A

United States Patent [19]

Westing et al.

[11] Patent Number: 5,314,390

[45] Date of Patent: May 24, 1994

[54] LINEAR TRACKING PROGRAMMABLE EXERCISER

[75] Inventors: Stephen Westing, Davis; Glen R. Mangseth, El Dorado Hills, both of Calif.

[73] Assignee: Loredan Biomedical, Inc., West Sacramento, Calif.

[21] Appl. No.: 898,969

[22] Filed: Jun. 12, 1992

Related U.S. Application Data

[63] Continuation-in-part of Ser. No. 110,347, Aug. 20, 1993, which is a continuation-in-part of Ser. No. 473,281, Jan. 31, 1992, abandoned.

[51] Int. Cl.[5] ..... A63B 21/005

[52] U.S. Cl. ..... 482/6; 482/8; 482/70; 482/111; 482/900; 482/901; 73/379.09; 601/36

[58] Field of Search ..... 482/1, 4–9, 482/52, 54, 56, 70–72, 91, 111, 900–903; 128/25 R, 25 B; 434/247; 73/379.01, 379.09

[56] References Cited

U.S. PATENT DOCUMENTS

| | | | |
|---|---|---|---|
| 3,323,366 | 6/1967 | DeLorme, Jr. et al. | 73/379.09 |
| 3,364,736 | 1/1968 | Bathurst et al. . | |
| 3,465,592 | 9/1969 | Perrine . | |
| 3,529,474 | 9/1970 | Olson et al. . | |
| 3,750,479 | 8/1973 | Gause et al. | 73/379.09 |
| 3,784,194 | 1/1974 | Perrine . | |
| 4,249,725 | 2/1981 | Mattox | 482/111 |
| 4,496,147 | 1/1985 | DeCloux et al. . | |
| 4,550,908 | 11/1985 | Dixon . | |
| 4,681,316 | 7/1987 | DeCloux . | |
| 4,691,694 | 9/1987 | Boyd et al. . | |
| 4,709,918 | 12/1987 | Grinblat | 482/72 |
| 4,733,858 | 3/1988 | Lan . | |
| 4,813,667 | 3/1989 | Watterson | 482/73 |
| 4,878,384 | 11/1989 | Bruhn | 73/379.01 |
| 4,900,013 | 2/1990 | Rodgers, Jr. . | |
| 4,907,797 | 3/1990 | Gezari et al. . | |
| 4,911,430 | 3/1990 | Flament . | |
| 4,958,830 | 9/1990 | Huggins et al. . | |
| 5,186,695 | 2/1993 | Mangseth et al. | 482/902 |

FOREIGN PATENT DOCUMENTS

| | | |
|---|---|---|
| 0199519 | 10/1986 | European Pat. Off. . |
| 2335544 | 1/1975 | Fed. Rep. of Germany . |

*Primary Examiner*—Richard J. Apley
*Assistant Examiner*—Joe H. Cheng
*Attorney, Agent, or Firm*—Townsend and Townsend Khourie and Crew

[57] ABSTRACT

A programmable limb exerciser wherein pedal motion is linear and the user may select isotonic, isokinetic or isoacceleration modes. The limbs may be exercised individually, reciprocally or in tandem. The exerciser can be readily re-oriented from a horizontal to vertical position for exercise of upper or lower body. A combination display and control panel provides information of the force exerted by each hand or foot, as well as number of repetitions and elapsed time, and provides a printout at the end of the exercise session.

33 Claims, 23 Drawing Sheets

LINEAR TRACKING PROGRAMMABLE EXERCISER

This application is a continuation-in-part of Ser. No. 08/110,347, filed Aug. 20, 1993, which is a continuation of Ser. No. 07/473,281, filed Jan. 31, 1992, now abandoned.

BACKGROUND OF THE INVENTION

This invention relates generally to exercise and rehabilitation systems and methods, and, more specifically, to a linear tracking isokinetic exerciser.

When the hip, thigh, knee or ankle are injured, rehabilitation includes increasing the range of motion of the affected joint as well as increasing muscle strength and endurance. It is also necessary to retrain normal gait characteristics, particularly with regard to symmetrical strength and movement of both limbs. Thus, physicians and physical therapist have become increasingly interested in multi-joint exercises that simulate the dynamics of actual limb movement.

U.S. Pat. No. 3,784,194 illustrates a known exercise device for bilaterally and reciprocally exercising a person's limbs. A person using the exerciser sits on an upright seat and places each of his or her feet through a loop of a pedal. The pedals are secured to a forward end of an L-shaped lever located on each side of the exerciser, and the levers are coupled to an actuator which isokinetically controls the motion of the levers. Although useful in many respects, the device lacks some desirable features. For example, the upright seat makes exercising awkward and inefficient. The reciprocating peddles move accurately and therefore do not properly simulate the forces encountered during actual walking. Movement of one limb inherently causes a corresponding movement in the other limb, so the device cannot isolate and exercise a single limb at a time. Analog hydraulic pressure gauges are used to measure the forces generated by each leg, but the indirect nature of the measurement only approximates the actual force being applied to the pedals. The needles in the gauges are not damped, so they bounce severely under even moderate use. Thus, unless gross differences exist between limbs, the gauges do not provide sufficient information for adequate gait or strength training.

SUMMARY OF THE INVENTION

The present invention is directed to an isokinetic limb exerciser wherein pedal motion is linear, and the limbs may be exercised alone or in combination. Forces are measured at the point of application and in such a manner that forces applied in any particular direction may be isolated.

In one embodiment of the invention directed to a recumbent bilateral reciprocal isokinetic leg exerciser, first and second reciprocating members are slidingly coupled to a linear track so that they move with linear bilateral reciprocal motion. Both reciprocating members are coupled to associated hydraulic cylinders so that hydraulic fluid is drawn into or forced out of the hydraulic cylinders as the reciprocating members move along the track. A valve assembly is coupled to the hydraulic cylinders for controlling fluid flow into and out of the hydraulic cylinders so that the reciprocating members move isokinetically. The valve assembly may be set for simultaneous movement of the first and second reciprocating members or for movement of one reciprocating member by itself. To ensure accurate measurement of patient effort, a strain gauge assembly is disposed on each reciprocating member for detecting deformation of the reciprocating member along multiple axes. The information obtained by the strain gauge assembly then may be used to calculate the actual forces being applied in a desired direction.

DETAILED DESCRIPTION OF THE PREFERRED EMBODIMENT

Figure 2:
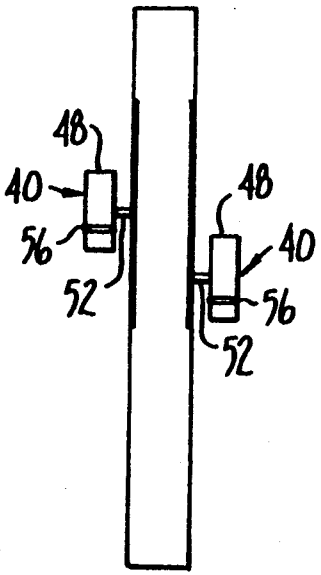
FIG. 2 is a view of the track assembly taken along line 2—2 of FIG. 1.
Figure 1:
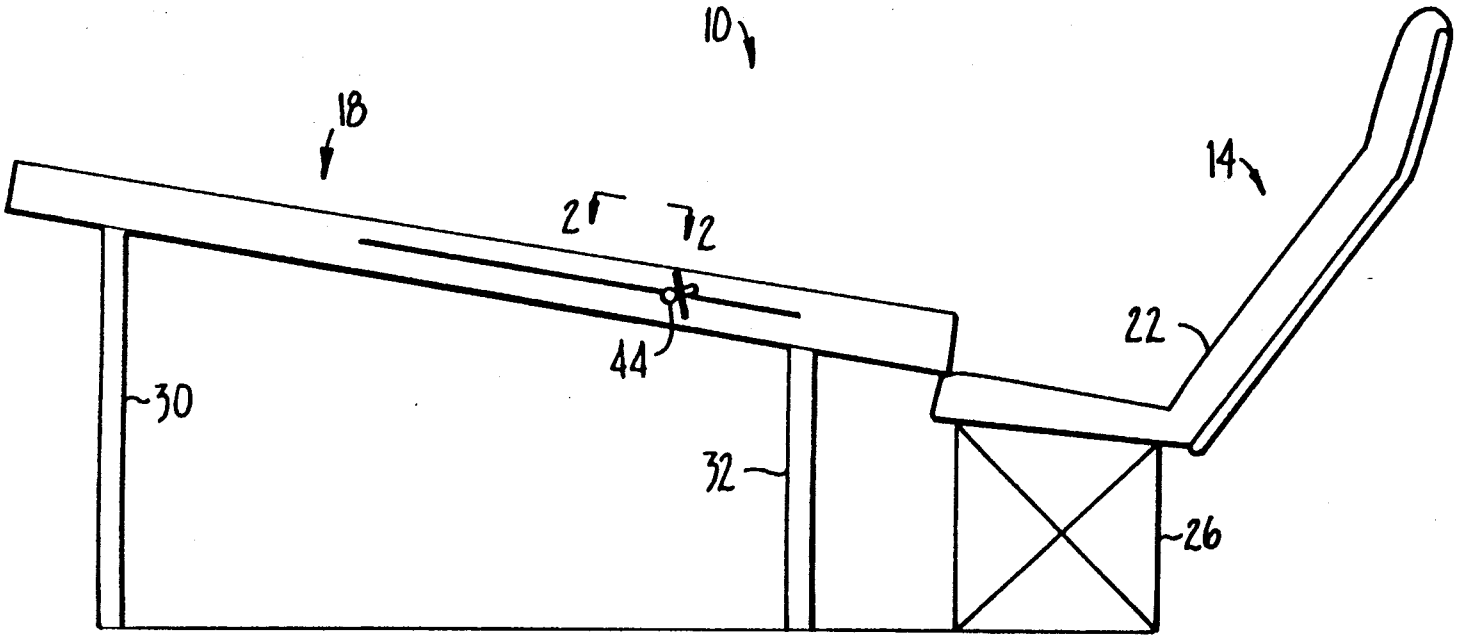
FIG. 1 is a perspective view of a particular embodiment of a recumbent exercise device according to the present invention.

FIG. 1 is a diagram of a recumbent exercise system 10 according to the present invention. Exercise system 10 includes a seating assembly 14 and a track assembly 18. Seating assembly 14 includes a cushioned seat 22 supported on a base 26 and is oriented to allow a patient to be seated in a recumbent position. Track assembly 18 is supported on base members 30, 32 Which may or may not be coupled to base 26. As shown in FIGS. 1 and 2, track assembly 18 includes first and second reciprocating members 40 and 44, respectively, located on opposite sides thereof. Each reciprocating member may include a pedal 48 attached to a shaft 52. A strap 56 may be provided for maintaining the user's foot against the pedal 48.

Figure 3:
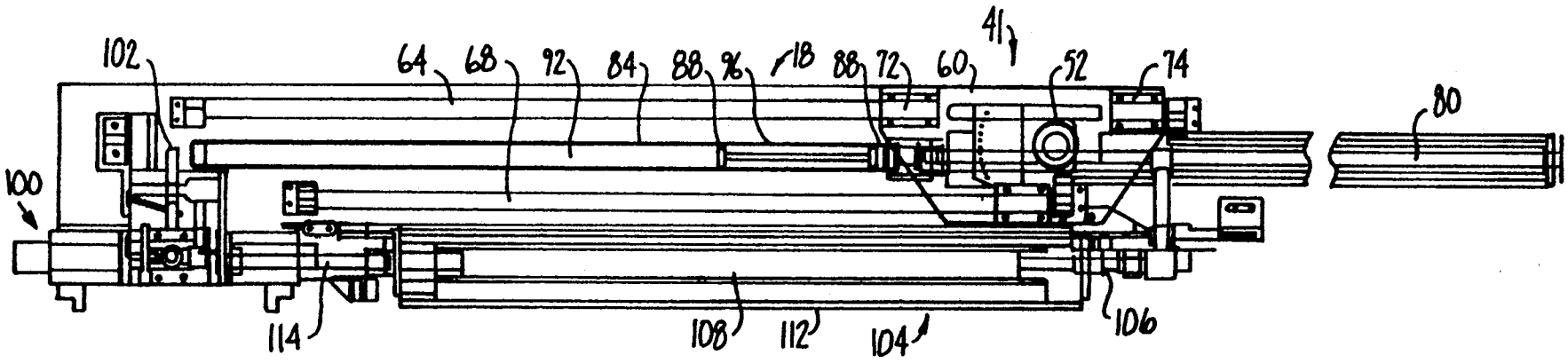
FIG. 3 is a more detailed view of the track assembly shown in FIG. 1.

FIG. 3 is a more detailed diagram of track assembly 18. As shown in FIG. 3, shaft 52 of reciprocating member 40 is mounted to a frame 60 which is slidingly mounted to tracks 64 and 68 via bearings 72, 74 and 76. Pedal 48 is not shown for clarity. Frame 60 is further coupled to a piston rod 80 which is part of a hydraulic cylinder 84. A piston 88 disposed within hydraulic cylinder 84 separates hydraulic cylinder 84 into a valve chamber 92 and an accumulator chamber 96. Valve chamber 92 is in fluid communication with a valve assembly 100 through a passage 102, whereas accumulator chamber 96 is in fluid communication with an accumulator assembly 104 through a passage 106. Reciprocating member 44 is structured in the same way, except that a single accumulator assembly 104 serves both reciprocating members.

Accumulator assembly 104 comprises a flexible container or bladder 108 disposed within a housing 112. Bladder 108 is fluidly coupled to accumulator chamber 96 through passage 106 and to valve assembly 100 through a passage 114. Housing 112 may be pressurized so that the hydraulic fluid stored within bladder 108 is under constant pressure. As a result, piston 88 is biased toward the valve assembly 100 to provide a default position for the reciprocating members.

Figure 4:
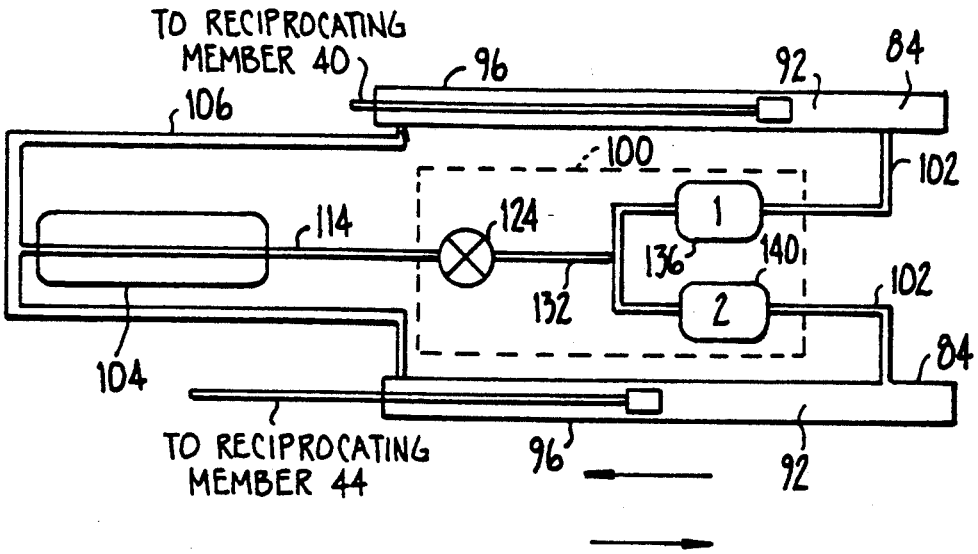
FIG. 4 is a hydraulic circuit diagram for the track assembly shown in FIG. 1.

FIG. 4 is a hydraulic circuit diagram for the present invention. As shown in FIG. 4, the accumulator chambers 96 of each hydraulic cylinder 84 are in fluid communication with each other and with accumulator assembly 104 through passage 106. The accumulator assembly 104 is also fluidly coupled to an accumulator valve 124 (within valve assembly 100) through passage 114. Accumulator valve 124 selectively couples passage 114 to a passage 132 which, in turn, is fluidly coupled to a first regulator assembly 136 and a second regulator assembly 140 within valve assembly 100. First regulator assembly 136 selectively couples passage 132 with the passage 102 leading to valve chamber 92 associated with reciprocating member 40. Similarly, second regulator assembly 140 selectively couples passage 132 with the passage 102 leading to valve chamber 92 associated with second reciprocating member 44. First regulator assembly 136 and second regulator assembly 140 operate to control the rate of fluid flow from and to valve chambers 92 so that first and second reciprocating members 40 and 44 move isokinetically.

From inspection of FIG. 4, it will be appreciated that, when accumulator valve 124 is closed and first and second regulator assemblies 136, 140 are regulating, then fluid flows out of chamber 92 associated with reciprocating member 40 and into chamber 92 associated with reciprocating member 44 when reciprocating member 40 is depressed, and vice versa. As a result, reciprocal movement will occur between first reciprocating member 40 and second reciprocating member 44. When accumulator valve 124 is open and first and second regulator assemblies 136, 140 are regulating, then first reciprocating member 40 and second reciprocating member 44 operate independently of each other at the velocities set by their associated regulators. When accumulator valve 124 is open and first regulator assembly 136 is shut off, then, if second regulator assembly 140 is regulating, first reciprocating member 40 is in a substantially locked state, and second reciprocating member 44 is free to move isokinetically. Similarly, if accumulator valve 124 is open and second regulator assembly 140 is shut off, then, if first regulator assembly 136 is regulating, second reciprocating member 44 is substantially in a locked position and first reciprocating member 40 is free to move isokinetically. When both first and second regulator assemblies 136 and 140 are shut off, then both first and second reciprocating members 40 and 44 are in substantially locked positions.

Figure 5:
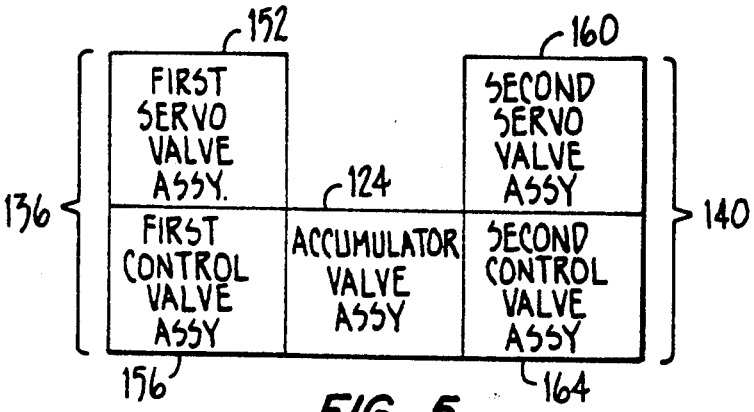
FIG. 5 is a block diagram showing a particular embodiment of a hydraulic valve assembly according to the present

FIG. 5 is a block diagram showing how the regulator and valve assemblies are constructed and physically located in this embodiment. First regulator assembly 136 comprises a first servo valve assembly 152 disposed adjacent to a first control valve assembly 156. Similarly, second regulator assembly 140 comprises a second servo valve assembly 160 disposed adjacent to a second control valve assembly 164. First control valve assembly 156 and second control valve assembly 164 are disposed adjacent to and on opposite sides of accumulator valve assembly 124.

Figure 6:
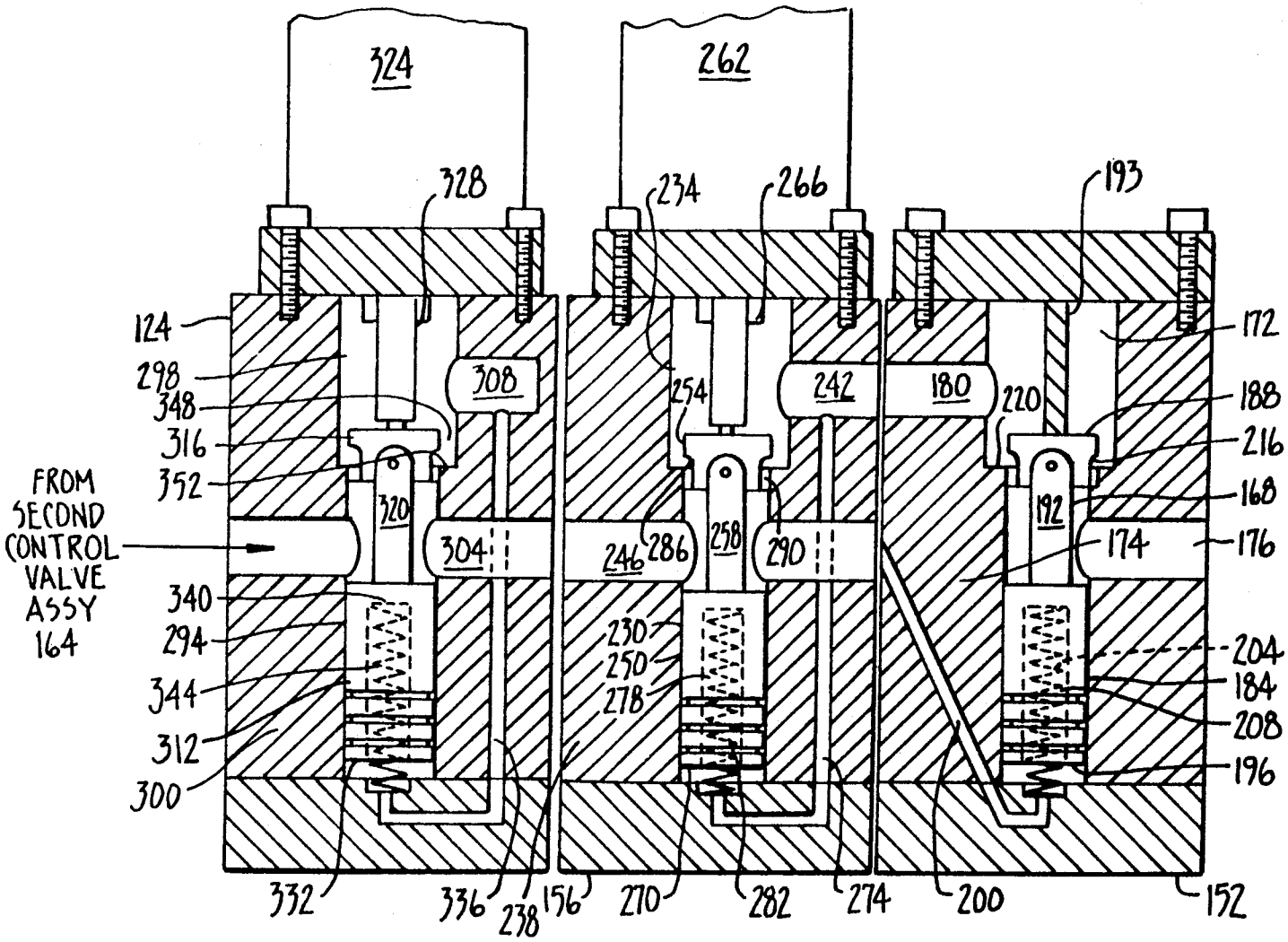
FIG. 6 is a cross-sectional diagram of particular embodiments of hydraulic accumulator, control, and servo valve assemblies according to the present invention.

FIG. 6 is a cross-sectional diagram of accumulator valve assembly 124, first servo valve assembly 152, and first control valve assembly 156. Second servo valve assembly 160 and second control valve assembly 164 are constructed in the same way, so a detailed discussion of them is omitted. First servo valve assembly 152 includes a first servo valve spool 168 fitted within a first servo valve bore 172 formed in a first servo valve body 174. First servo valve bore 172 is in fluid communication with a first servo valve fluid inlet passage 176 and a first servo valve fluid outlet passage 180. First servo valve fluid inlet passage 176 is in fluid communication with the valve chamber 92 associated with reciprocating member 40 via passage 102 (FIG. 4).

First servo valve spool 168 includes a first servo valve spool piston portion 184 and a first servo valve spool seating portion 188 which is coupled to and spaced apart from first servo valve spool piston portion 184 by a first servo valve spool connecting rod 192. First servo valve spool piston portion 184 is sealingly fitted within first servo valve bore 172 and terminates in a free end 196. The portion of first servo valve bore 172 adjacent to free end 196 is in fluid communication with a servo valve pressure coupling passage 200 for reasons discussed below. First servo valve spool piston portion 184 includes a cavity 204 in which is disposed a spring 208 for biasing first servo valve spool seating portion 188 against an abutment 193. First servo valve seating portion 188 includes a servo valve seat contact portion 216 for contacting a servo valve seat 220 formed by valve body 174. It should be apparent that when first servo valve spool 168 is in the position shown in FIG. 6, then fluid flows relatively freely from first servo valve fluid inlet passage 176 to first servo valve fluid outlet passage 180. On the other hand, when first servo valve seat contact portion 216 is contacting servo valve seat 220, fluid flow between first servo valve fluid inlet passage 176 and first servo valve fluid outlet passage 180 is inhibited. First servo valve spool seating portion 188 is shaped so that the cross-sectional flow area created by first servo valve spool seating portion 188 and first servo valve bore 172 increases as the first servo valve seat contact portion 216 moves progressively away from first servo valve seat 220.

First control valve assembly 156 includes a first control valve spool 230 fitted within a first control valve bore 234 formed within a first control valve body 238. First control valve bore 234 is in fluid communication with a first control valve fluid inlet passage 242 and a first control valve fluid outlet passage 246. First control valve fluid inlet passage 242 is in fluid communication with first servo valve fluid outlet passage 180. First control valve fluid outlet passage 246 is in fluid communication with servo valve pressure coupling passage 200 for coupling the hydraulic pressure in first control valve outlet passage 246 to the free end 196 of first servo valve spool piston portion 184 for reasons discussed below.

First control valve spool 230 includes a first control valve spool piston portion 250 and a first control valve spool seating portion 254 which is coupled to and spaced apart from first control valve spool piston portion 250 by a first control valve spool connecting rod 258. A control valve solenoid 262 is coupled to the upper portion of first control valve body 238. Control valve solenoid 262 includes a control valve solenoid plunger 266 which extends into first control valve bore 234 toward first control valve spool seating portion 254.

First control valve spool piston portion 250 is sealingly fitted within first control valve bore 234 and terminates in a free end 270. The portion of first control valve bore 234 adjacent to free end 270 is in fluid communication with a control valve pressure equalizinq passage 274 which, in turn, is in fluid communication with first control valve fluid inlet passage 242. Control valve pressure equalizing passage 274 assures that there is no net hydraulic bias on first control valve spool 230. First control valve piston portion 250 also includes a cavity 278 within which is disposed a spring 282 for biasing first control valve spool seating portion 254 against first control valve solenoid plunger 266.

First control valve spool seating portion 254 includes a control valve seat contact portion 286 for contacting a control valve seat 290 formed by valve body 238. Additionally, first control valve spool seating portion 254 is shaped so that the cross-sectional flow area created by first control valve spool seating portion 254 and first control valve bore 234 increases as the first control valve seat contact portion 286 moves progressively away from first control valve seat 290. As a result, fluid flow between first control valve inlet passage 242 and first control valve outlet passage 246 is inhibited when first control valve seat contact portion 286 contacts first control valve seat 290, and then fluid flow gradually increases as first control valve seat contact portion 286 moves away from first control valve seat 290.

Accumulator, valve assembly 124 includes an accumulator valve spool 294 fitted within an accumulator valve bore 298 formed within an accumulator valve body 300. Accumulator valve bore 298 is in fluid communication with an accumulator valve fluid inlet passage 304 and an accumulator valve fluid outlet passage 308. Accumulator valve fluid inlet passage 304 is in fluid communication with first control valve fluid outlet passage 246. Additionally, accumulator valve fluid inlet passage 304 is in fluid communication with the second control valve outlet passage (not shown) in second control valve assembly 164. Accumulator valve fluid outlet passage 308 is in fluid communication with accumulator 104 via passage 128 (FIG. 4).

Accumulator valve spool 294 includes an accumulator valve spool piston portion 312 and an accumulator valve spool seating portion 316 that is coupled to and spaced apart from accumulator valve spool piston portion 312 by an accumulator valve spool connecting rod 320. An accumulator valve solenoid 324 is coupled to the upper portion of accumulator valve body 300. Accumulator valve solenoid 324 includes an accumulator valve solenoid plunger 328 which extends into accumulator valve bore 298 toward accumulator valve spool seating portion 316.

Accumulator valve spool piston portion 312 is sealingly fitted within accumulator valve bore 298 and terminates in a free end 332. The portion of accumulator valve bore 298 adjacent to free end 332 is in fluid communication with an accumulator valve pressure equalizing passage 336 which, in turn, is in fluid communication with accumulator valve fluid outlet passage 308. Accumulator valve pressure equalizing passage 336 insures that there is no net hydraulic bias on accumulator valve spool 294. Accumulator valve spool piston portion 312 further includes a cavity 340 within which is disposed a spring 344 for biasing accumulator valve spool seating portion 116 against accumulator valve solenoid plunger 328.

Accumulator valve spool seating portion 316 includes an accumulator valve seat contact portion 348 for contacting an accumulator valve seat 352 formed by accumulator valve body 300. Thus, fluid flow between accumulator valve input passage 304 and accumulator valve outlet passage 308 is inhibited when accumulator valve seat contact portion 348 contacts accumulator valve seat 352, whereas fluid flows relatively freely between accumulator valve fluid inlet passage 304 and accumulator valve fluid outlet passage 308 when accumulator valve seating portion 316 is in the position shown.

In operation, accumulator valve solenoid 324 positions accumulator valve spool 294 in the open or closed position depending on whether or not fluid flow is to be allowed between first and second regulating assemblies 136, 140 and accumulator 104 as discussed above. First control valve assembly 156 (and second control valve assembly 164) set the basic fluid flow rate for the desired isokinetic velocity. To do this for first reciprocating member 40, control valve solenoid 262 is activated so t hat a selected position of first control valve spool 230 is correspondingly set. Where control valve solenoid plunger 266 (and hence control valve spool 230) is positioned depends on the desired isokinetic velocity, since velocity is determined by the rate of fluid flow through the valves. The lower the desired velocity, the closer first control valve seat contact portion 286 is to control valve seat 290.

The rate of fluid flow between first control valve fluid inlet passage 242 and first control valve fluid outlet passage 246 depends on the pressure of the fluid in first control valve inlet passage 242 as well as the cross-sectional orifice area formed by first control valve seating portion 254 and control valve seat 290. Thus, to insure isokinetic operation it is necessary to accommodate for fluid pressure differences caused by the varying amounts of force applied to first and second reciprocating members 40 and 42 by the patient. That is the function of first servo valve assembly 152 (and second servo valve assembly 160). When hydraulic pressure increases at first servo valve inlet passage 176, a pressure differential occurs relative to the free end of first servo valve spool 168. This occurs because of servo valve pressure coupling passage 200 which is coupled to first control valve outlet passage 246. Consequently, a net downward force is exerted on first servo valve spool 168. This causes the first servo valve seat contact portion 216 to approach first servo valve seat 220, thus decreasing flow between first servo valve fluid inlet passage 176 and first servo valve fluid outlet passage 180. The reduced fluid flow therefore compensates for the increased pressure, and isokinetic velocity is maintained.

Figure 7:
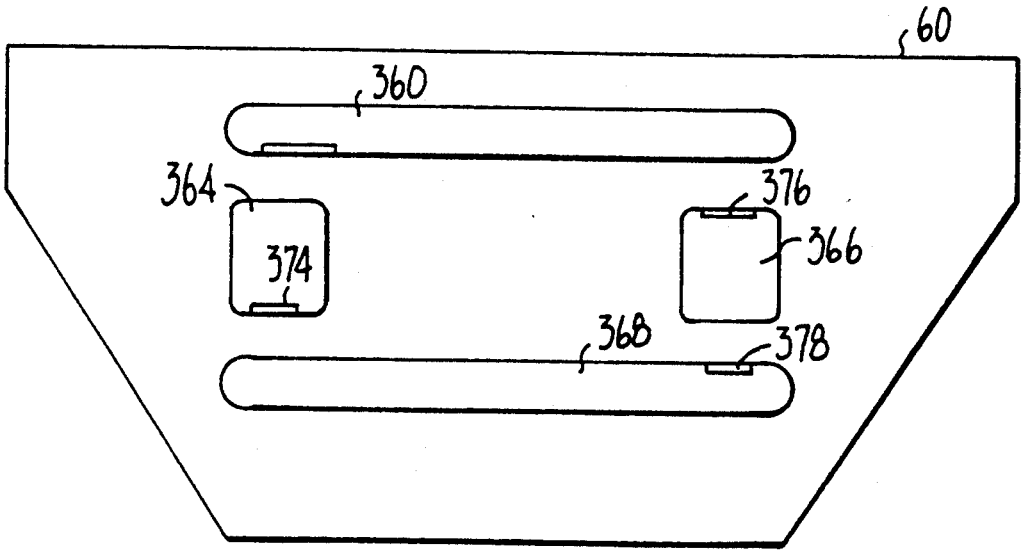
FIG. 7 is a diagram strain gauge locations according to the present invention.

Another important feature of the present invention is the technique used for detecting and calculating force applied to the first and second reciprocating members by the patient. Rather than sensing hydraulic pressure as is done in conventional devices, force is detected at the point of application, and a signal indicating the force applied in a particular direction (e.g., along the axis of the track) is provided to the user. This is accomplished by using the strain gauge assembly shown in FIG. 7. As shown in FIG. 7, frame 60 is provided with a plurality of apertures 360-368 with a corresponding plurality of strain L gauges 370-378 located as shown. By locating the strain gauges in this manner, the amount of deformation of frame 60 along dissimilar axes, and hence the forces applied to frame 60 in any direction, may be calculated.

While the above is a complete description of a preferred embodiment of the present invention, various modifications may be employed. For example, FIGS. 8-12 are diagrams of another embodiment of an exercise system according to the present invention. In this embodiment, the exercise system includes a seat assembly A2 removably attached to a guide assembly A1, and a base A5. Seat assembly A2 includes a cushioned seat A3, mounted on a second base A27. When attached, the seat is oriented to allow a patient to be seated in a recumbent or semi-recumbent position. The seat base is parallel to the ground at a height of approximately 21". The seat back orientation is adjustable in angle to accommodate different desired hip flexion angles, adjusting from 90 degrees to 60 degrees in 15 degree increments.

A guide A1, with an axis A28, (FIG. 10) is provided to direct the motion of the reciprocating members along a line parallel to the axis. The guide has components sufficiently strong and rigid to resist deflection by the reciprocating members during use, and may be constructed of metal beams of any suitable cross sectional shape. The beams forming the guide may be provided with channels in which bearings for the reciprocating members may slide, or some other provision may be made to keep the reciprocating members aligned for movement with respect to the axis of the guide. The guide should allow for 36 inches of travel for each reciprocating member.

Figure 8:
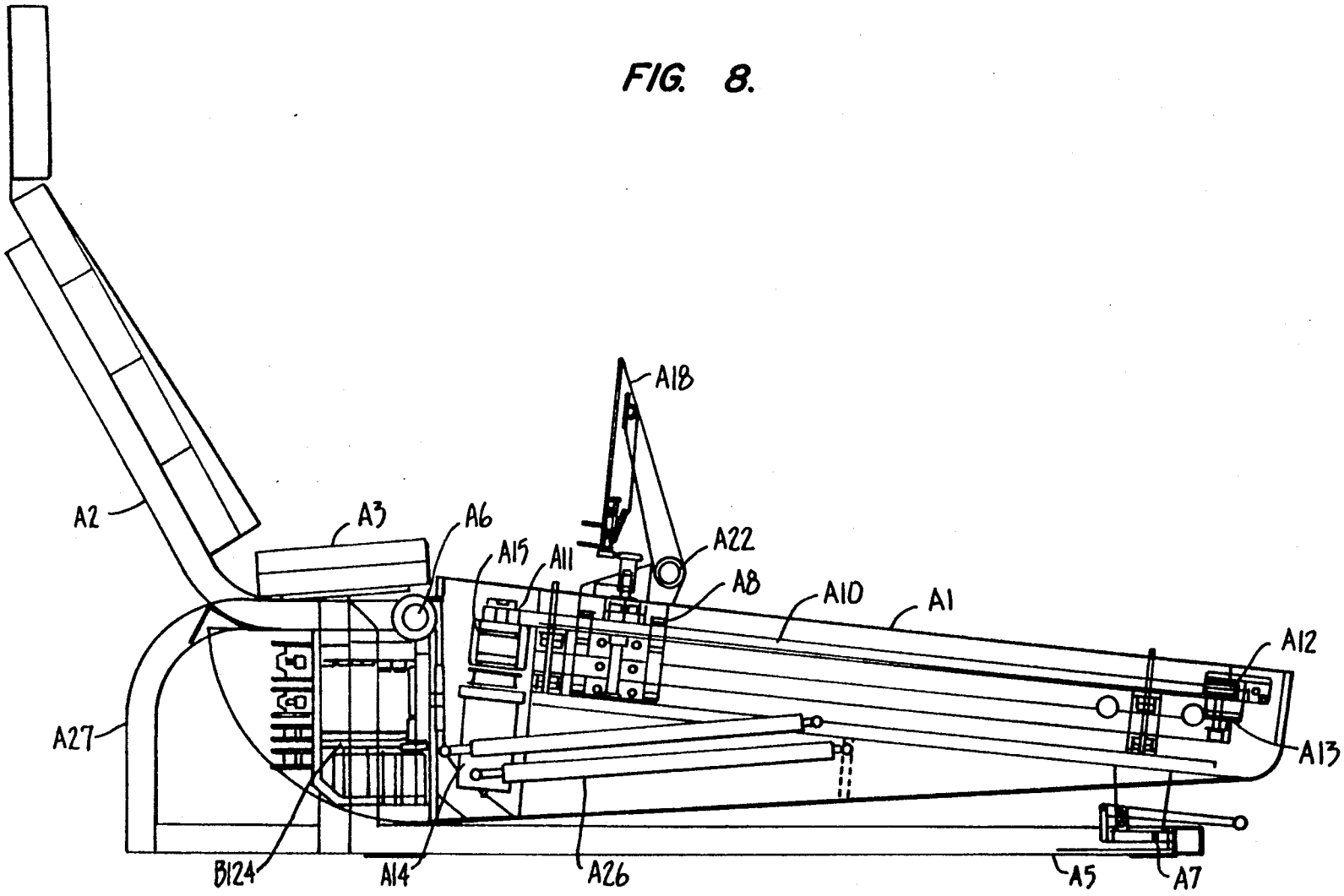
FIG. 8 is a side view of a second embodiment of an exercise device according to the present invention.
Figure 9:
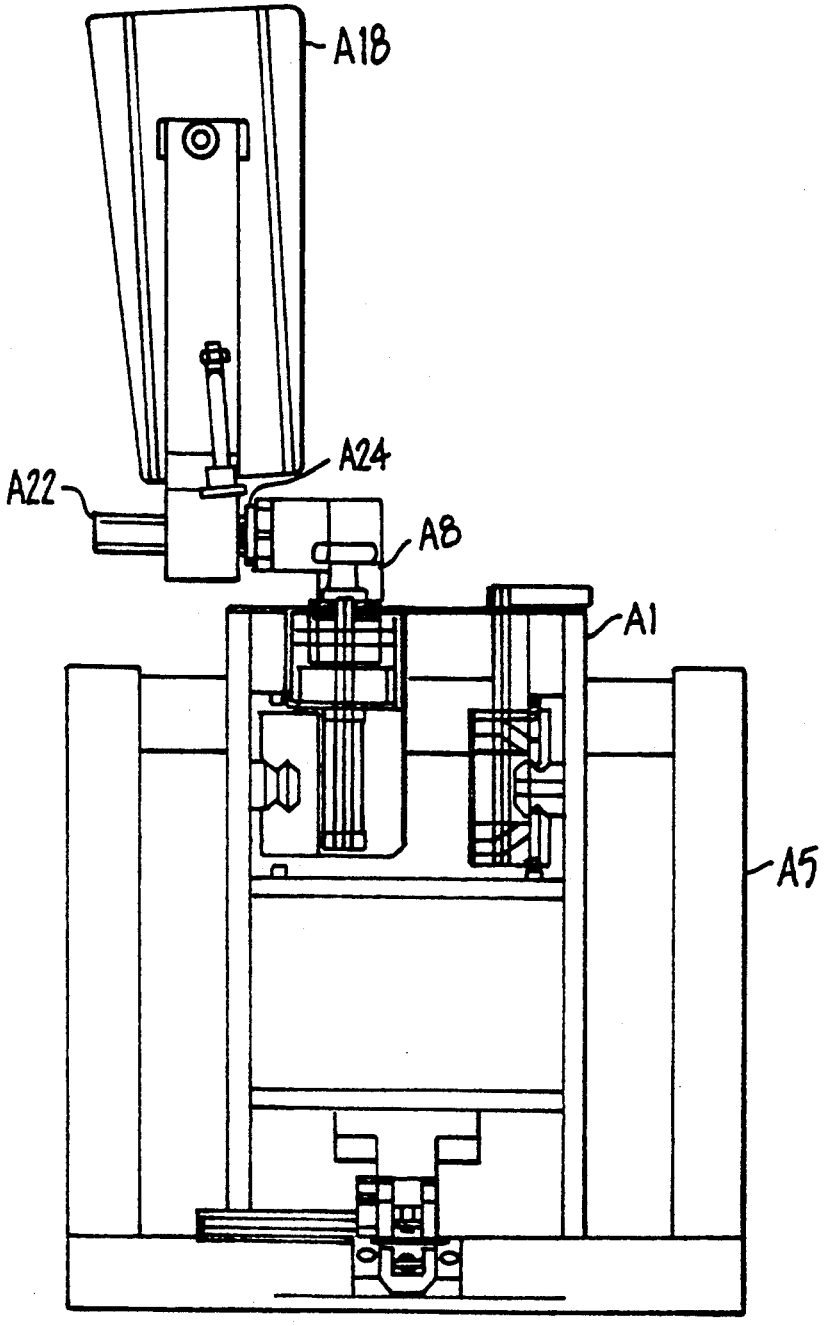
FIG. 9 is a cross sectional view of the track and reciprocating member according to the second embodiment.
Figure 11:
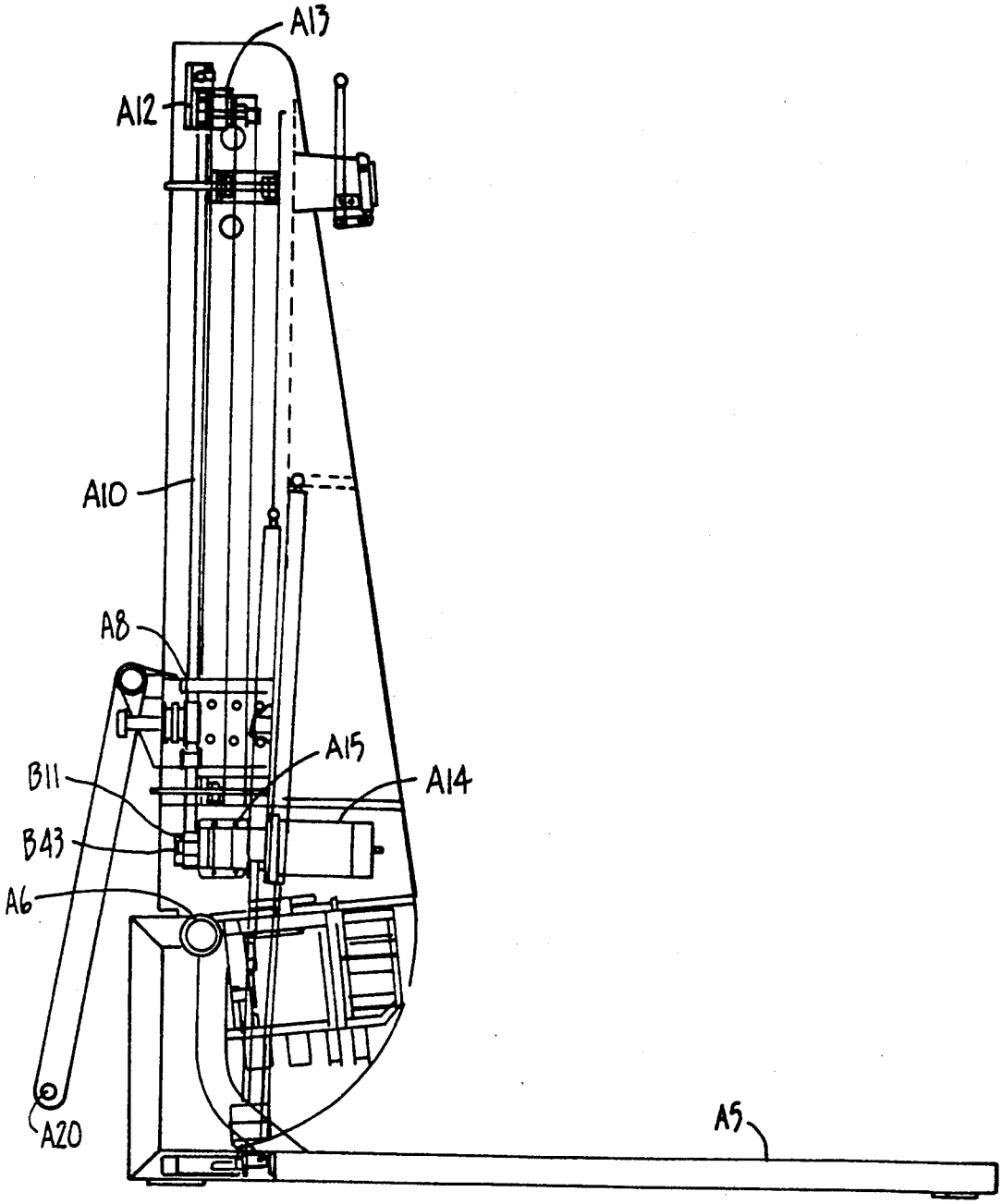
FIG. 11 is a view of the second embodiment rotated into the vertical position for exercising the upper body.
Figure 12:
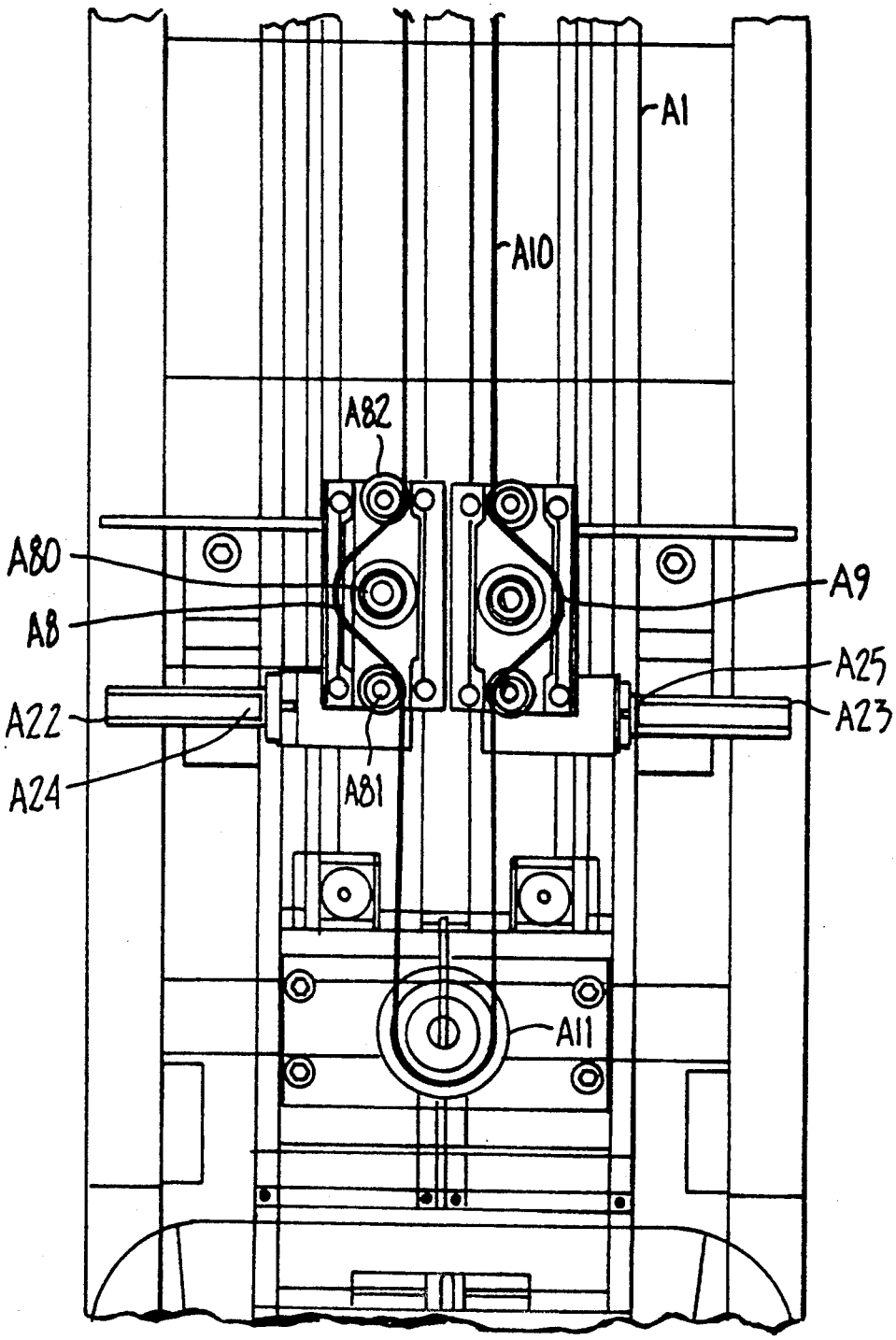
FIG. 12 is a diagram of the reciprocating members locked to move in tandem

Guide A1 is attached to the base A5 by means of a pivoting joint A6 (FIG. 8) at the end of the base closest to the user and a releasable joint A7 at the other end. In its horizontal position, the axis should be oriented at an angle between approximately 5 degrees and approximately 10 degrees to the floor, with the high end closest to the user. By opening the releasable joint A7, the guide can be rotated about the pivoting joint to a vertical position, as shown in FIG. 11. A latch is provided for securing the guide in a vertical position. Dampers may also be provided to smooth the motion of the guide during repositioning, such as by one or more shock absorbers A26 (FIG. 8). The force required to reposition the guide is reduced by providing one or more concentric springs at the pivot point. A counterweight may also be used. In the preferred embodiment, the guide can be repositioned through the exertion of a force of no more than ten pounds.

Figure 10:
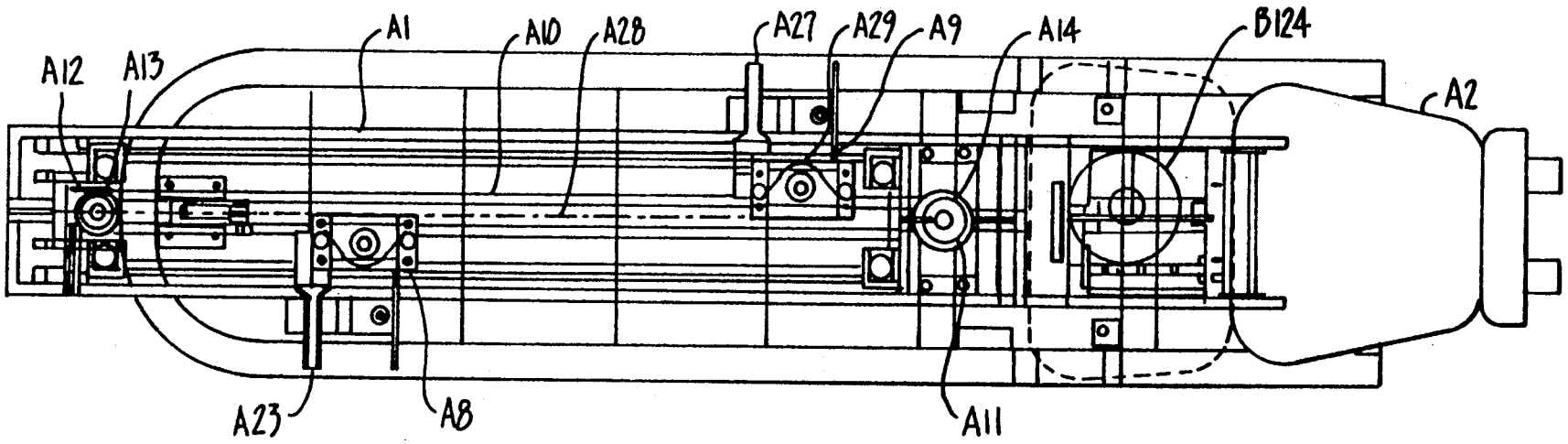
FIG. 10 is a view of the second embodiment as seen from above.

As shown in FIG. 10, slidably attached to beams A1 are first and second reciprocating members A8 and A9, respectively, located on opposite sides of the beams. The reciprocating members may move in grooves or slots disposed in the surface of the guide or may be configured to encircle one side of the guide. Bearings may be used to insure that the reciprocating members slide smoothly along the guide. Provision may be made for removing the reciprocating member from the guide or for locking the reciprocating member into a fixed position along the guide, such as by incorporating a clamp into the reciprocating member.

The reciprocal motion of the sliding members is transmitted to a position based motion controller A14 by a belt or a chain A10, suspended between pulleys or sprockets A11, A12 near either end of the guide. It is only necessary that these pulleys lie beyond the expected range of motion of the sliding members, so, for example, the pulley nearest the user may be some distance from the end of the guide, leaving room for a seat or other support attached to the guide. One of these pulleys A12, preferably the one farthest from the user, serves to keep the belt in tension, preferably by being attached to a belt tensioner A13, or by having its axis of rotation fixed relative to the guide. The other pulley drives a position based motor controller A14, either directly or, preferably, by means of a gear reduction arrangement A15 (FIG. 8).

Figure 29:
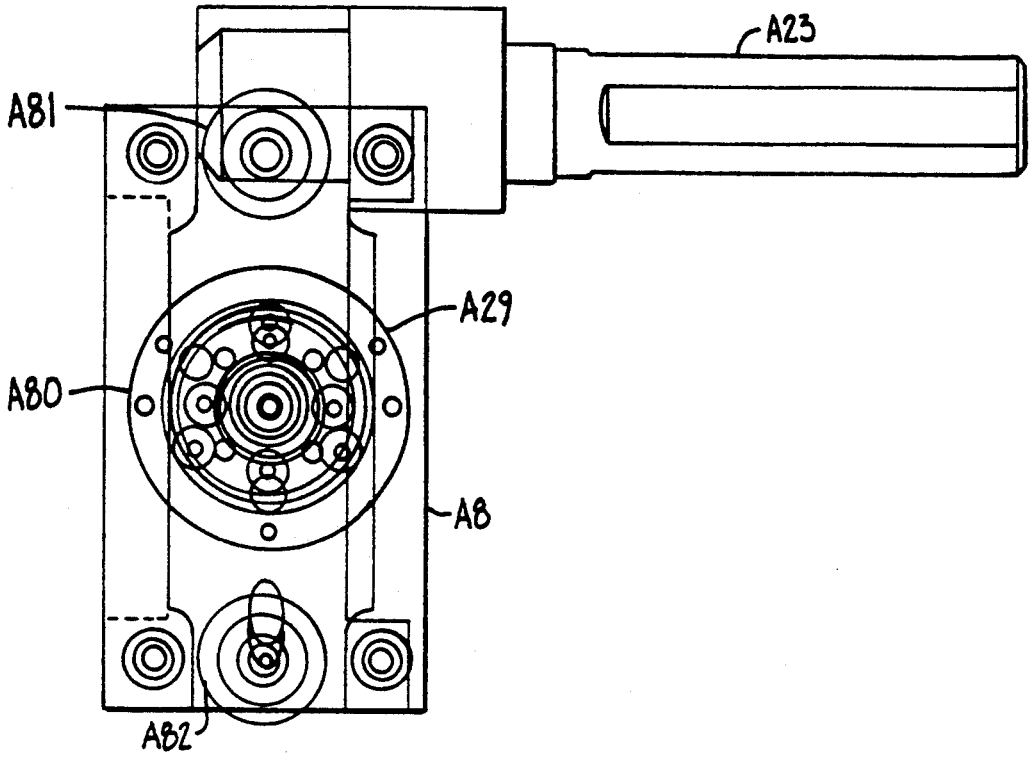
FIG. 29 is a top view of the clamping mechanism for releasably attaching the reciprocating members to the belt.
Figure 30:
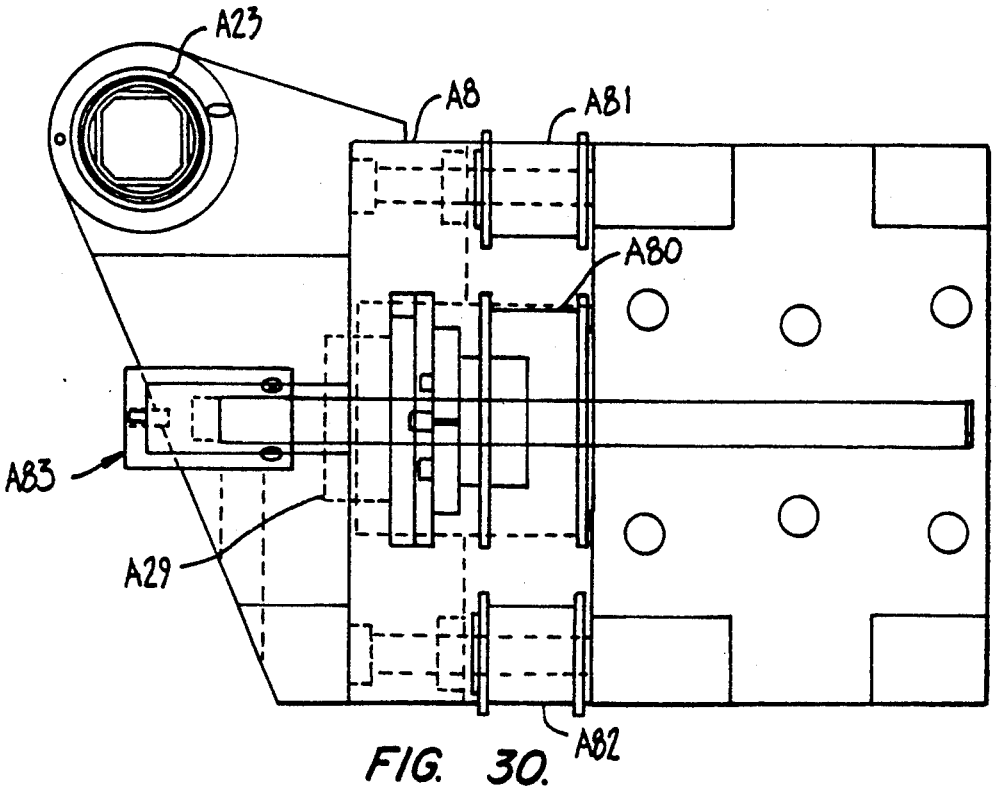
FIG. 30 is a side view of the clamping mechanism for releasably attaching the reciprocating members to the belt.

The reciprocating members are adapted to releasably engage the belt or chain, such as by a clamp A29. FIGS. 29 and 30 are detailed views of this clamping mechanism, which consists of an arrangement of three pulleys A80, A81 and A82, between which the belt passes, as may be seen in FIGS. 10 and 12. By adjusting the locking mechanism A83, the pulley A80 can be locked in place or left free to rotate about its axis. When locked in place, the reciprocating member A8 is constrained to move with the belt A10. Allowing the pulley to rotate permits the reciprocating member to slide along the belt.

When both reciprocating members are engaged with the belt or chain, they move in a reciprocal fashion and, by moving the belt or chain back and forth, turn the position based motion controller, which controls the motion, as described below. When only one reciprocating member is engaged with the belt, the disengaged reciprocating member may be locked in a remote position or completely removed from the guide. When so configured, the apparatus can be used for exercising only one leg or arm without danger and inconvenience of the other reciprocating member moving along the guide. Alternatively, the disengaged reciprocating member may be locked into a different position to serve as a support for the leg or arm not being exercised.

Figure 28:
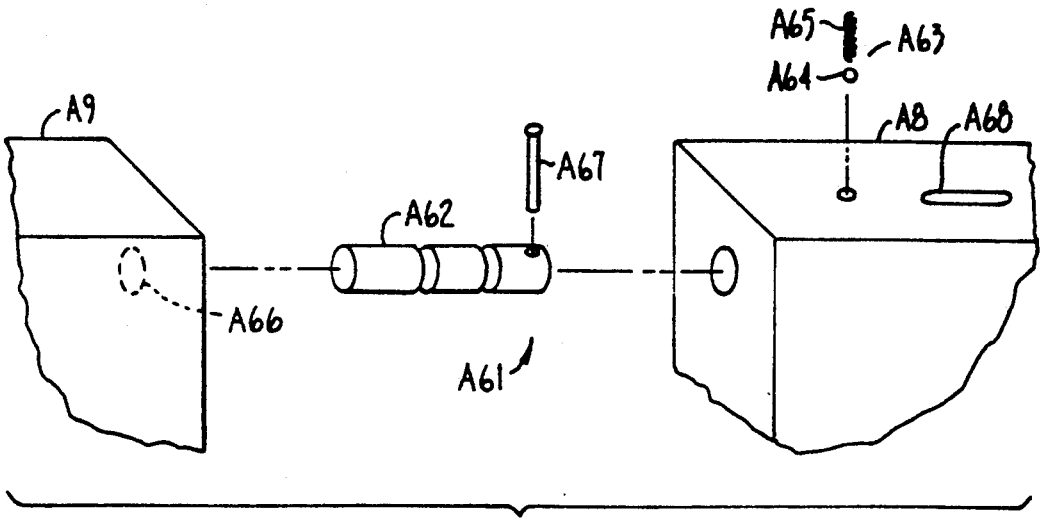
FIG. 28 is a diagram of a latch for tandem motion of the reciprocating members.

Provision is also made, in the preferred embodiment, for configuring the apparatus so that the reciprocating members move in unison rather than reciprocally. This can be accomplished by providing a latch for connecting the reciprocating members together and disengaging one of the members from the belt or chain. One possible latching arrangement is shown in FIG. 28. The latch A61 consists of a cylindrical bolt A62 contained in one reciprocating member A8 which the operator slides, by moving a handle A67 in a slot A68, into an opening A66 in the other reciprocating member A9. An indent stop A63, consisting of a ball A64 urged against the bolt by a spring A65, are provided to prevent the bolt from moving out of position as the reciprocating members move. When the reciprocating members are so configured, both reciprocating members move in unison. Alternatively, a second clamp may be provided for attaching one of the reciprocating members to the belt or chain on the opposite side of the axis.

When one reciprocating member is disengaged from the belt and latched to the other reciprocating member, the two reciprocating members will move in unison and their motion will still be controlled by the belt.

The reciprocating members may be fitted with a variety of user interfaces, such as pedal A18 (FIG. 8), or handle A20 (FIG. 11), whereby the user may grasp or push on the reciprocating members.

In the preferred embodiment, these user interfaces fit onto the ends of shafts A22, A23 protruding from the reciprocating members in a horizontal plane and perpendicular to the axis of the guide. The user interfaces receive the application of force from the user at a predetermined distance from the axis of the shafts, thereby transmitting a torque to the shaft.

In the horizontal position, user interfaces in the form of footplates permit leg press exercises with the legs moving either reciprocally or in tandem. The angle between the footplate and the horizontal is adjustable. The angle may be locked in ten degree increments from 100 degrees to 40 degrees or permitted to rotate about its axis. Elastomer bumpers limit the extreme range of motion at approximately 115 degrees and 35 degrees. The center line of the pivot points on the footplates is 12" above and 12" forward of the front edge of the seat when the reciprocating members are in their most proximal position.

By changing the user interface to handgrips, chest press or lat row exercises can be performed. The handgrips are disposed on separate armatures, permitting either reciprocal or tandem exercise. Both the chest press/lat row user interfaces and the leg press interfaces can be attached to the guide at the same time, permitting simultaneous exercise of all four extremities. By tilting the guide to a vertical, or near vertical, position, the upper body can be exercised. Other handgrips are provided for shoulder press, lat pulldown, or bench press exercises. A lift attachment is provided, consisting of a single bar attached to the reciprocating means terminating in a ring that a length of chain can attach to. Handles attached to a chain are provided as well as a platform upon which the user may stand. Depending on the length of the chain, lifting exercises from floor to waist, waist to shoulder, and shoulder to overhead may be performed.

Figure 27:
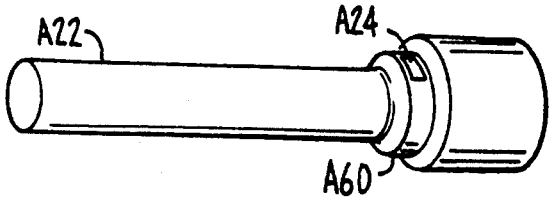
FIG. 27 is a strain gauge diagram for a second embodiment of the present invention.

Force exerted upon the user interface means is measured directly by sensors (strain gauges) A24, A25 (FIGS. 12, 27) preferably mounted on the shafts A22, A23, which sense the deformation of the shaft under the torque resulting from the force applied by the user. More than one strain gauge may be used on each shaft. In the preferred embodiment, two strain gauges are mounted on the shaft at diametrically opposed positions. A shoulder A60, or other form of restraint, is employed to protect the strain gauges from damage by the user interfaces. By measuring force directly at the user interfaces, independent measurements are obtained for each limb being exercised. The signals from the sensors are then converted into a measure of the force applied, which is then displayed to the user, as explained below.

Figure 14:
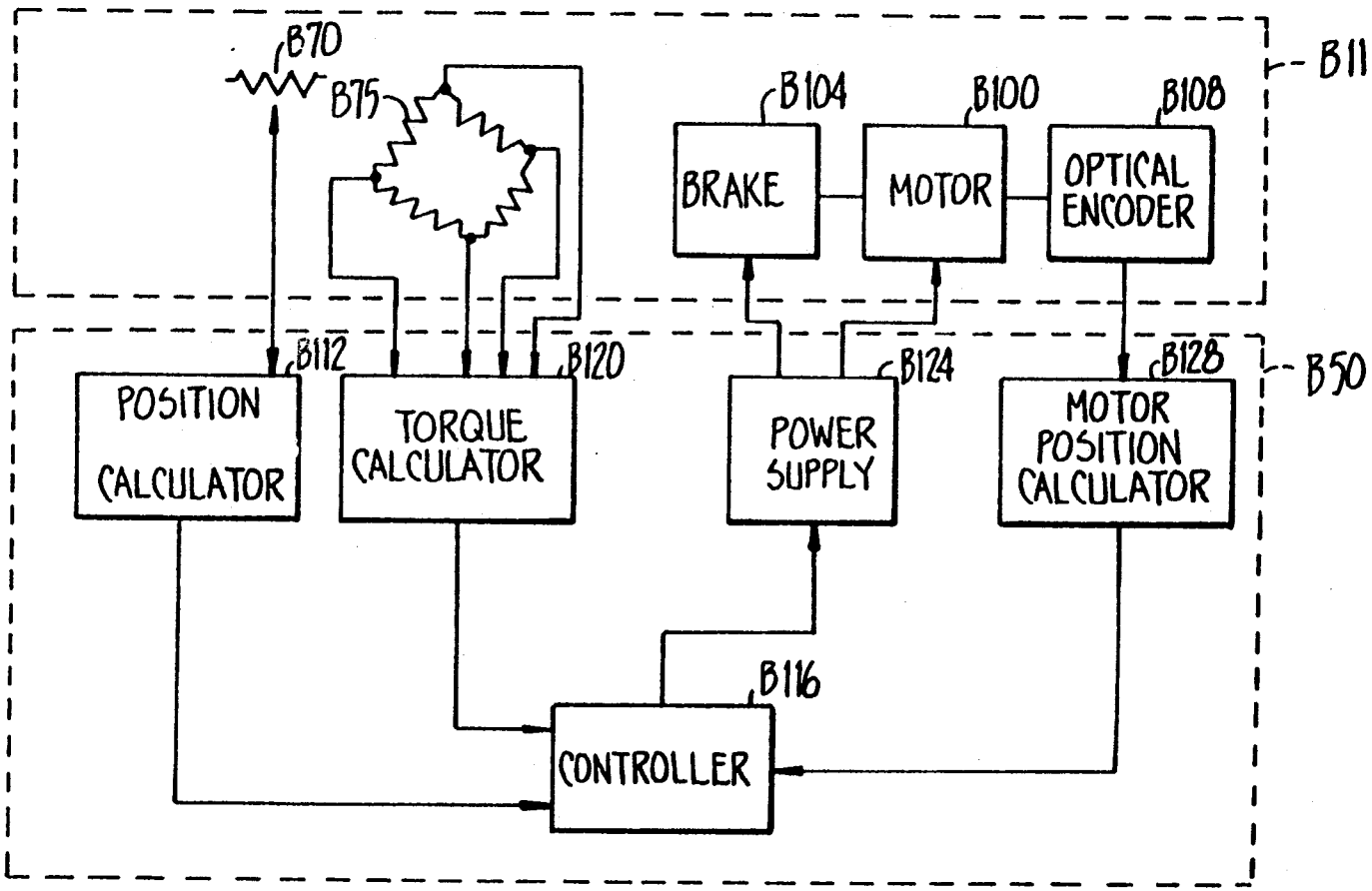
FIG. 14 is a partial block diagram of a particular embodiment of the electrical components of the position-based motion controller according to the present invention.

The movement of the reciprocating members is controlled by a position based motion controller A14, which controls rotation of pulley or sprocket A11 in response to the position of and torque applied to the pulley or sprocket. The motion controller includes a potentiometer B70 (FIG. 14) for measuring the angular position of the reciprocating member, and a strain gauge assembly B75 for measuring the torque applied to the reciprocating members. Active exercise resistance unit B11 further includes a motor B100 for actively controlling the rotation of shaft B43, a brake B104 for maintaining shaft B43 in a fixed position, and an optical encoder B108 for detecting the position of the motor shaft. Optical encoder B108 is calibrated to potentiometer B70 so that optical encoder B108 provides a separate indication of the angular position of the pulley or sprocket.

Computer system B50 includes a position calculator B112 which receives position signals from potentiometers B52 and B70. Position calculator B112 indicates the angular position of the pulley, as determined by potentiometer B70, to a controller B116. A torque calculator B120 receives signals from strain gauge assembly B75 and provides a signal to controller B116 indicating the torque applied to the pulley or sprocket A11. A power supply B124 receives control signals from controller B116 for controlling the operation of brake B104 and motor B100. A motor position calculator B128 receives signals from optical encoder B108 and provides signals indicating the position of motor B100 to controller B116. The structure and operation of position calculator B112, torque calculator B120, power supply B124, and motor position calculator B128 are well known and will not be discussed here.

Controller B116 is programmed to regulate the movement of pulley 11 via motor B100 in response to the position and torque signals received from position calculator B112 and torque calculator B120. During passive or concentric exercise modes, when the motor acts as a brake, the isokinetic velocity is adjustable from 0 to 50 in/sec in 5 in/sec increments. During active exercise, when the motor provides the driving force, the isokinetic velocity is adjustable from 0 to 25 in/sec. The maximal requirements for both braking and driving force is 250 lbs. This driving force is required during the entire velocity range of 0 to 25 in/sec during the active exercise modes. In the passive modes, this resistive force decreases roughly linearly as velocity increases, reaching as low as 125 lbs at 50 in/sec.

The controller may also be combined with a user display to provide information to the user concerning the exercise undertaken. This information can be displayed on a display and control panel incorporated into the machine, or a personal computer can be used. In the preferred embodiment, the user is provided the option of using a built in display and control panel or attaching the device to a personal computer for a wider variety of exercise modes and data storage capabilities. Thus, for example, a relatively inexpensive built-in control and display panel can be provided which permits the selection of isotonic or isokinetic exercise and displays and prints information regarding the exercise session being undertaken. By adding a personal computer, the user can "upgrade" the device to one capable of isoacceleration mode and which can store data from a variety of exercise sessions and a variety of users.

Figure 13:
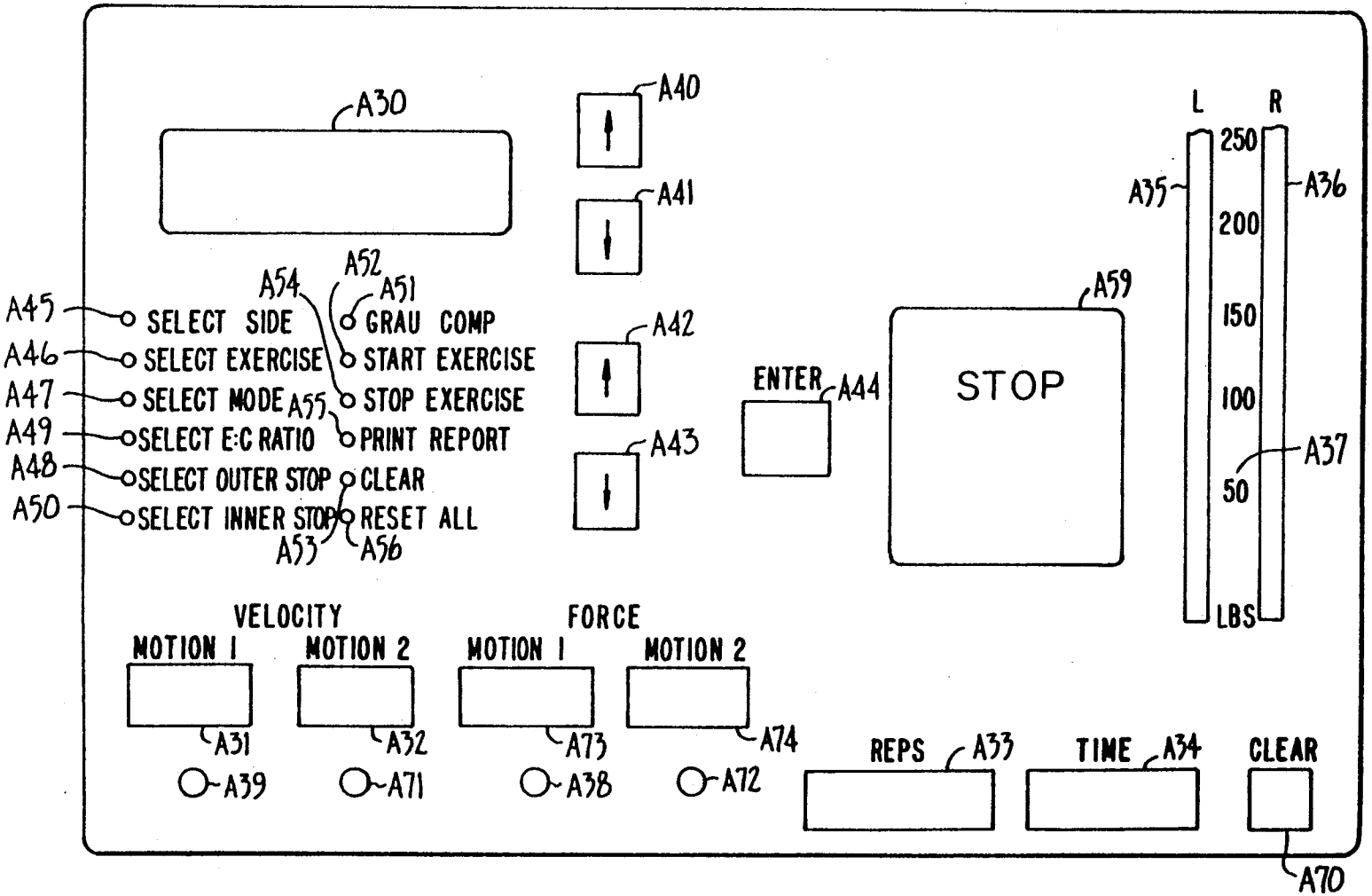
FIG. 13 is a view of a possible control panel.

FIG. 13 shows one configuration for a display and control panel. The built in control panel permits the user to, for example, select the type of exercise, adjust velocity and force parameters of the exercise, set the range of motion, perform gravity compensation, adjust the velocity and force in real time, receive real time visual bio-feedback on individual forces from both extremities separately, keep count of repetitions and elapsed time, record test data and generate printed reports.

With the addition of an optional personal computer, the user can display real time biofeedback, select more sophisticated exercise modes, such as isoacceleration or Challenge-like protocols, archive test data, display results in multiple formats, print graphical summaries and progress reports, perform normative statistics, and develop a personalized database.

The operation of the control panel, FIG. 13, will now be described. The LED lights A45–A56, on the control panel to the left of the various functions are green. The green window A30 in the upper left hand corner allows for two lines of 20 alphanumeric characters per line. The velocity windows A31, A32 and force windows A73, A74, the rep counter A33 and time counter A34 are green seven-segment LED displays. The Force bars A35, A36 are 5 inches high, consisting of 50 LED bars each. The force bars represent 5 to 250 lbs in 5 lb increments. These bars are labeled every ten bars (50, 100, 150, 200, 250). The voltage potentiometers A38, A72 adjusting force is of the 10-turn variety. Force is adjustable in 1 lb increments. To adjust velocity, the user turns a dial A39 A71 with discrete clicks to 0, 5, 10 . . . 50 in/sec, by 5 in/sec intervals.

The operation of the various controls will now be described.

Select Side: using the lower arrow buttons, A42, A43, the user scrolls through the parameters until the select side LED A45 is illuminated. The options appear in the window A30. The side selections are Both Sides, Left Side, or Right Side. The default option is Both Sides. By using the upper arrow buttons A40, A41 the user scrolls through these three options. Once the desired side is selected, the user can either press the Enter button A44, or use the lower arrow keys to move on to another parameter selection. Pressing Enter automatically moves the user to Select Exercise and illuminates LED A46.

Select Exercise: Pressing Enter automatically moves the user to Select Mode A47. The user then scrolls through the options available and selects by pressing Enter. The default option is Leg Press.

Select Mode: When Both Sides is selected, Isokinetic Passive or Isokinetic Active is the mode options. When either Left Side or Right Side is selected, the options are: Isokinetic Con/Con, Isokinetic Con/ECC-1, Isokinetic Con/ECC-2, CPM, Isotonic Con/Con, Isotonic Con/Ecc-1, and Isotonic Con/Ecc-2. Pressing Enter automatically moves the user to Set Outer Stop A48 (unless isokinetic con/ecc-1 or 2; Select E:C Ratio). When Both Sides has been selected, the default option is Isokinetic Passive. When Left Side or Right Side has been selected, the default option is Isokinetic Con/Con.

Select E:C Ratio A49. When mode is set to isokinetic con/ecc-1 or con/ecc-2, the user can select ratio options of 0.5:1, 1.0:1, 1.5:1, 2.0:1 or No Ratio. When any other mode is selected, this function is skipped over. Pressing Enter automatically moves the user to Select Outer Stop. The default option is 1.0:1.

Select Outer Stop & Select Inner Stop: Setting the range of motion (ROM) involves separately setting an outer stop and an inner stop. The upper set of arrow keys actively control the motor in half-inch steps. In the case of Both Sides Leg Press exercise, the outer stop is the extended position of the right leg. The range of values is from 0.0 to 36.0 inches, with 0.5 inch resolution. Changing the position of either stop erase the gravity compensation data. The user adjusts the outer stop (followed by Enter or down arrow from the lower set of arrow keys), adjust the inner stop A50, and press Enter or a down arrow from the lower set of arrow keys to proceed to Grav Comp A51.

Grav Comp: Once the ROM is set, the user performs Grav Comp (gravity compensation) by pressing Enter. This takes the pedals or other attachments through the complete ROM at no faster than 10 in/sec (move the pedals at 5 in/sec if velocity is set to 5 in sec), and "weigh the limb" at 100 Hz. Grav Comp always takes place from inner to outer stop and back again. This "limb weight" information is used to zero out the system. After gravity compensation is complete, the system moves the user automatically to Start Exercise, and the pedals are moved to the starting position of the exercise. Once at the starting point, the motor is used to hold the pedals in the starting position until Start Exercise A52 is selected.

Start Exercise: It is necessary to make this selection before any and all exercises. Starting exercise automatically zeros the rep and time counters and clears the data storage buffer. Once exercise is started the cursor moves to Stop Exercise A55. Data storage commences as soon as exercise begins. To collect only selected repetitions, the user presses Clear A60 to erase any warm up reps from the buffer, then Stop Exercise A54 to end data collection.

Stop Exercise: For passive exercise the exercise only comes to an end once the patient's force output drops below some minimum threshold, while for active exercise the motor ramps down the speed to some minimum level before stopping. Once Stop Exercise has been pressed, the curser moves to Print Report A55.

Print Report: It is possible to produce a printed report once an exercise is complete. The data remains in memory until a new exercise has begun, the system has been shut off, or Reset A11 A56 has been used. Printing a report does not move the cursor from Print Report. It is possible to return to Print Report and re-print the same report if the data has not yet been erased. Currently two printout forms are available; a summary report and a rep-by-rep report.

Clear ROM A53. Should the user wish to reset the ROM or test another patient, making this selection erases the gravity compensation data and sets both the outer and inner stops to the current pedal position (right pedal during Both Sides or Right Side operation, left pedal during Left Side operation). All other parameters remain unchanged.

Reset A11 A56: Selecting this function sets both outer and inner stops to the current pedal position, erases gravity compensation data and any stored exercise data, and sets Side to Both Sides.

Clear Counters A70: Reps (max 999 before rolling back over to zero) and Time (max 99:59 before rolling back over to zero) begin accumulating as soon as the Start Exercise button has been pressed. These counters can be reset at any time during exercise by pressing Clear A70. This action also clears the data buffer. It is possible to press Clear multiple times in a single exercise, i.e., re-clear.

Stop: The function of this large red button A59 is to stop exercise immediately. If Stop is pushed during exercise, data from any complete repetitions is stored and printable (this also moves the user to Print Report).

If Stop is pushed during a non-exercise state the cursor stays where it is and the current LCD display remains.

Velocity: Velocity for Motion-1 and Motion-2 are adjustable with switches A39, A71 that have either 11 or 13 discrete positions. During Both Sides operation only one velocity may be selected). During isotonic operation, both velocities are displayed. The range is 0 to 50 in/sec, with 5 in/sec resolution (0 to 120 cm/sec, with 10 cm/sec resolution for SI boards). Velocity during active exercise is limited to 25 in/sec. For active exercises, every second click on the switch represents 5 in/sec (intermediate clicks do not affect the setting).

Force: Force for Motion-1 and Motion-2 are adjustable with 10-turn dials A38, A72. During isokinetic operation, Force acts as a force limit. During isotonic operation, Force acts as the resistive load. The range should be 10 to 250 lbs, with lb resolution. During Both Sides operation, both force settings are displayed.

The operation of the motion controller will now be described. In operation, computer B50 is powered up, and the operator enters the patient data and desired operating parameters. For example, the operator may specify the rate of acceleration/deceleration, the maximum torque, and the maximum range of motion of the reciprocating members. Once the range of motion is set, a gravity compensation routine is executed to obtain table values that are used to compensate for the effect of gravity on the reciprocating members A8, A9 throughout the set range of motion. An acceleration table routine is also performed to obtain table values that are used to effect the desired acceleration throughout the set range of motion. Once the operating parameters are established, the user may enter a number of exercise types and/or modes. For example, the operator may specify a concentric/concentric mode of operation wherein the patient actively pushes on the reciprocating members A8, A9 during both clockwise and counterclockwise motion of the pulley or sprocket A11. Additional modes include concentric/eccentric and eccentric/concentric modes wherein the patient pushes on the reciprocating members A8, A9 in one direction, and the reciprocating members push back in the other direction; a continuous positive motion (CPM) mode wherein the reciprocating members move the patient's limb in both directions at a prescribed speed (or acceleration); an isometric mode wherein the reciprocating members resist applied force; a move limb mode wherein the patient's limb is moved to a prescribed position within the set range of motion at a selected speed; an idle mode wherein the reciprocating members are in a passive state; and a lock limb mode wherein the reciprocating members are maintained in a locked position. In concentric/concentric, concentric/eccentric, eccentric/concentric, CPM and move limb modes, torque is limited to the maximum value set by the operator. That is, if the patient pushes on the reciprocating members (or resists the motion of the reciprocating members) with a force which produces a torque that exceeds the value set by the operator, then the acceleration value set by the operator is overridden, and the velocity of the reciprocating members is allowed to increase sufficiently to bring the torque within the set maximum.

The operator also may specify a plurality of exercise types. For example, the operator may specify isokinetic exercise at a selected velocity or isoacceleration/deceleration exercise at a set acceleration. Isotonic exercise may be achieved by entering concentric/concentric mode with a selected velocity of zero and a nonzero maximum torque. Isometric exercise is achieved by locking a reciprocating member assembly in a fixed position.

Figure 15:
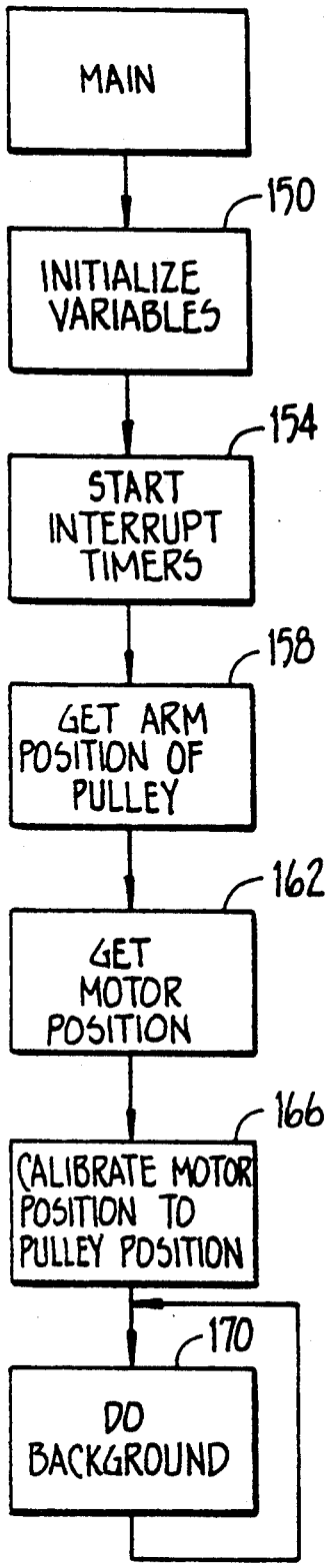
FIGS. 15–26 are flow charts illustrating a particular method of operation of a position-based motion controller according to the present invention.

The exercise session begins with execution of a MAIN routine shown in FIG. 15. The MAIN routine begins by initializing variables in a step 150. An interwoven interrupt program structure is used in this embodiment, so a 400 hertz interrupt timer is started in a step 154. The pulley position is retrieved in a step 158, and the motor position is retrieved in a step 162. The motor position then is calibrated to the pulley position in a step 166. Thereafter, a background routine is performed in a step 170 until the exercise session is ended or aborted.

The background routine executes in a continuing loop unless and until there is a 400 hertz interrupt which causes execution of a 400 hertz routine. After each four executions of the 400 hertz routine, a 100 hertz routine is called. The 100 hertz routine performs the necessary calculations on the input data, whereas the 400 hertz routine ensures that the proper amount of current is supplied to motor 100.

Figure 16:
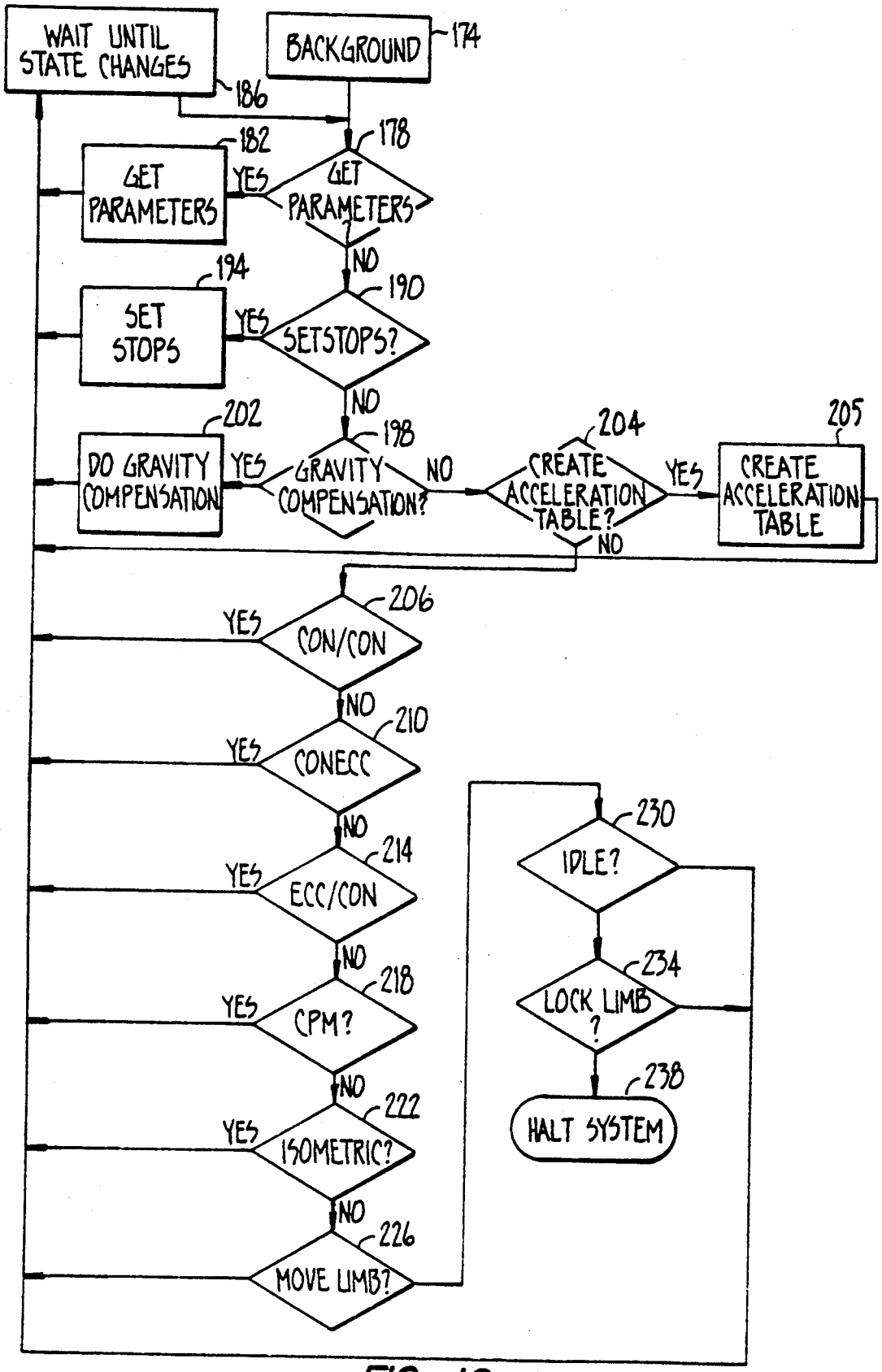

Execution of the background routine begins in a step 174 (FIG. 16). The background routine is primarily a passive routine which maintains the status quo until the 100 hertz or 400 hertz routines execute. The only time the background routine executes a routine having any effect on the system is when parameters are input to the system, when the range of motion of the reciprocating member is set, or when gravity compensation for the reciprocating member is to be performed.

Figure 19:
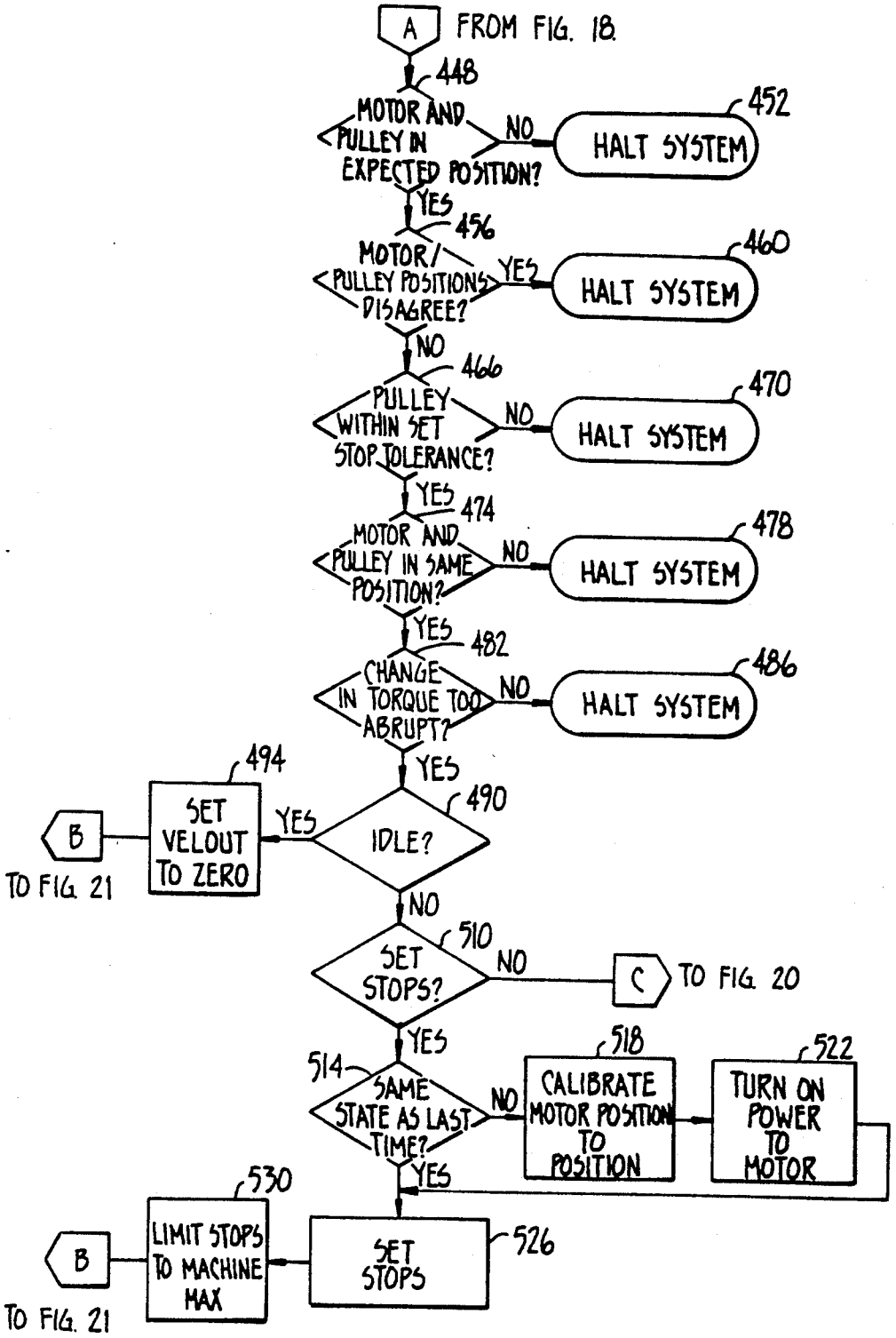
Figure 20:
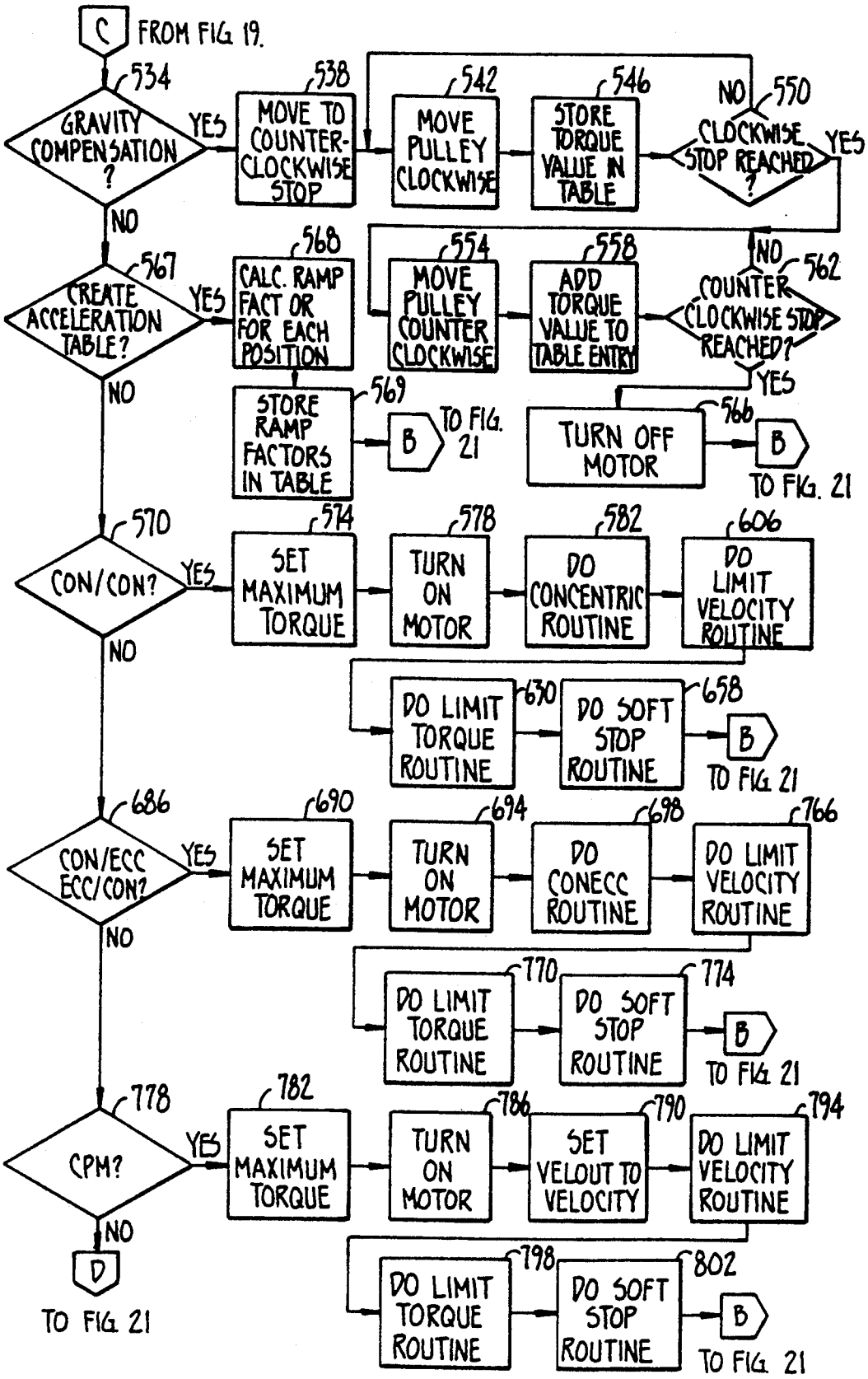

It is then ascertained in a step 178 whether controller 116 has been instructed to obtain parameters from the operator. If so, the parameters (e.g., isokinetic velocity, desired acceleration, maximum torque, patient data, etc.) are obtained in a step 182, and execution continues in a step 186 by waiting until the state changes. If parameters are not to be input at this time, then it is ascertained in a step 190 whether controller 116 has been instructed to set the range of motion of the reciprocating members (i.e., set clockwise and counterclockwise rotational stops). If so, then a set stop routine is executed in a step 194. Details of this routine will be discussed in conjunction with FIG. 19. Once the clockwise and counterclockwise stops are set, processing continues in step 186 until the state changes. If the stops are not to be set at this time, then it is ascertained in a step 198 whether the gravity compensation routine is to be executed. If so, then the gravity compensation routine is executed in a step 202, and processing continues in step 186. Details of the gravity compensation routine will be discussed in conjunction with FIG. 20. If a gravity compensation is not to be performed at this time, then it is ascertained in a step 204 whether an acceleration table routine is to be executed. If so, then the acceleration table routine is executed in a step 205, and processing continues in step 186. Details of the acceleration table routine will be discussed in conjunction with FIG. 20.

If the acceleration routine is not to be performed at this time, then it is ascertained in steps 206–234 whether one of the valid exercise types or modes or system states has been specified. If so, then processing merely continues in step 186. If none of the valid exercise types or modes or system states has been specified, then system operation ceases in a step 238.

Figure 17:
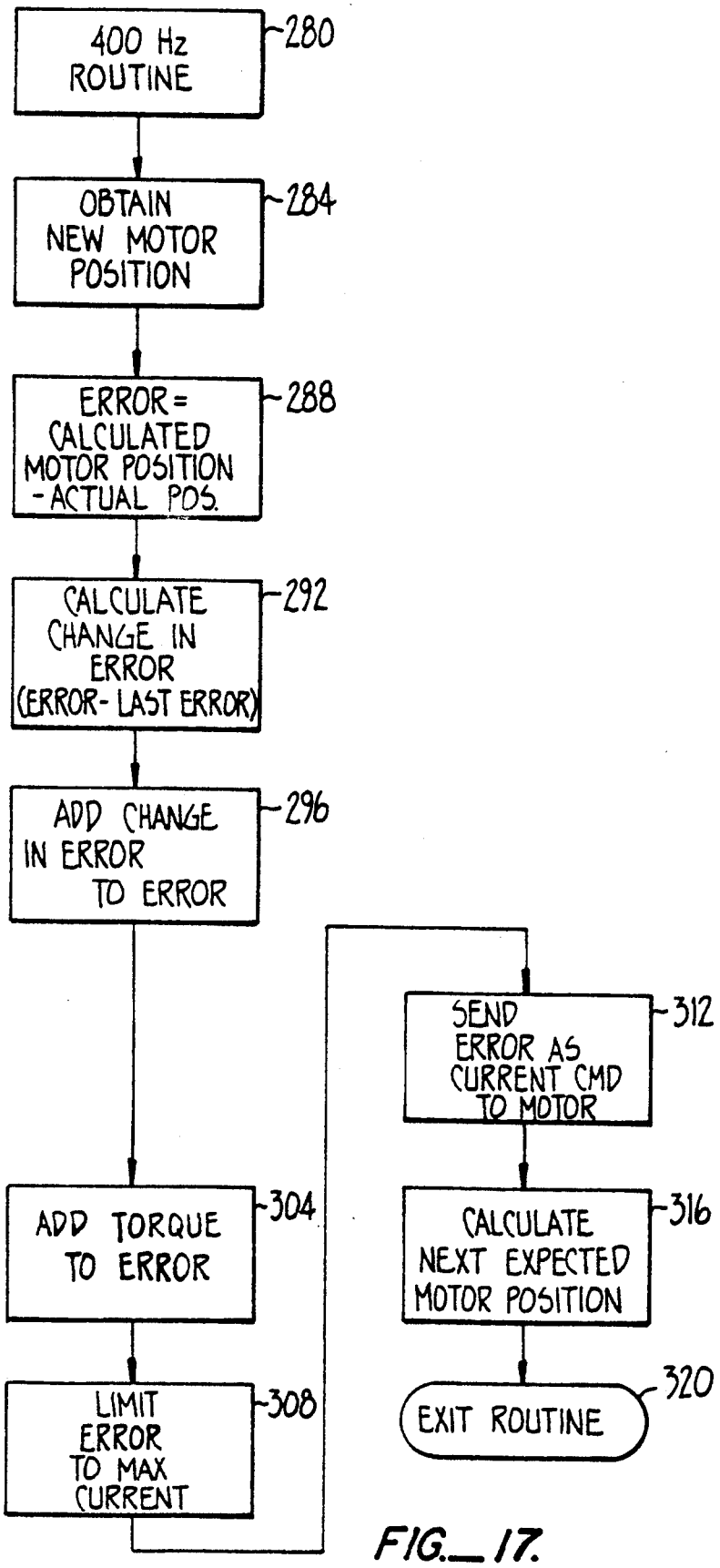

The background routine continues until a 400 hertz interrupt occurs. When the 400 hertz interrupt is received, the 400 hertz routine begins in a step 280 as shown in FIG. 17. The 400 hertz routine compares the actual motor position with an estimated motor position that was calculated based upon a value, termed VELOUT400, which is a position ramp factor derived either from the desired velocity parameter (isokinetic exercises) or acceleration parameter (isoacceleration, isodeceleration exercises) input by the operator. If the calculated motor position does not match the actual motor position, then a current command is given to power supply 124 to increase or decrease the amount of current supplied to motor 100.

As shown in FIG. 17, the actual motor position (derived from the optical encoder) is obtained in a step 284. Thereafter, an error value is determined by subtracting the actual motor position from the calculated motor position in a step 288. The amount of change in the error value from the last time the error value was calculated is determined in a step 292. Then, the change in the error value is added to the error value in a step 296. To predict the motor current required to oppose the torque which caused the error, the present torque is added to the error value in a step 304. To ensure that the new error value does not represent a current beyond the maximum allowed motor current, the error value is limited to the set motor current maximum in a step 308. The limited error value is sent as a current command to the DAC (not shown) in controller 116 which addresses power supply 124 in a step 312. Finally, the next expected motor position is calculated in a step 316, and the 400 hertz routine is exited in a step 320.

Figure 18:
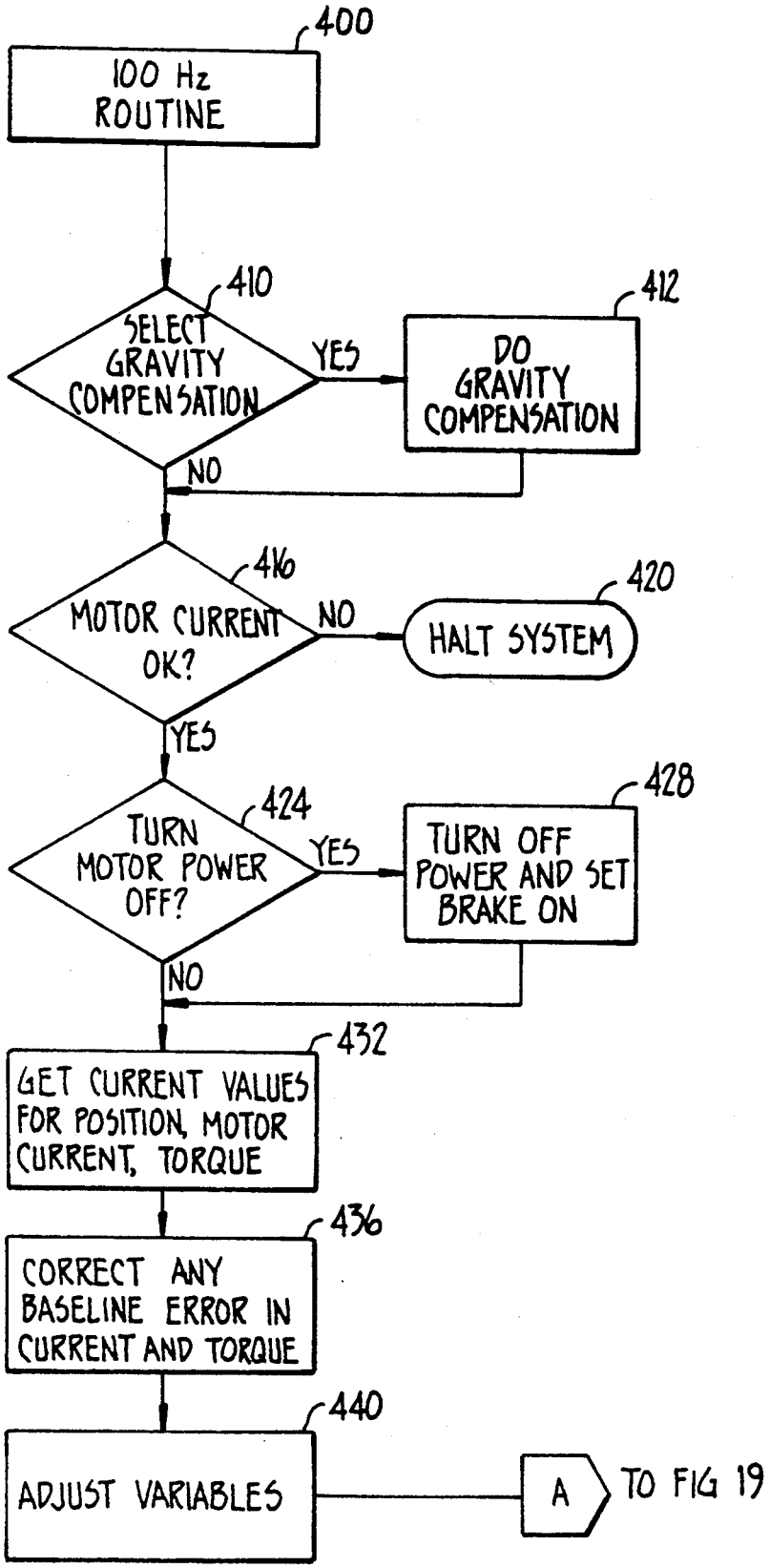

After the 400 hertz routine executes four times, the 100 hertz routine is called. The 100 hertz routine begins in a step 400 shown in FIG. 18. In general, the 100 hertz routine performs various safety checks and updates the value of VELOUT400 (used to control motor current in the 400 hertz routine) based on the position and applied torque signals for each operating state. The 100 hertz routine begins by ascertaining in a sep 410 whether gravity compensation is to be performed. If so, then the gravity compensation routine is performed in a step 412. It is then ascertained in a step 416 whether the motor current is at a safe level. This may be determined by modeling the temperature of the motor based on current supplied to the motor. If the motor current is not at a safe level, then the system is halted in a step 420 to ensure the safety of the operator and patient. If the motor current is within safe limits, it is then ascertained in a step 424 whether the motor power should be turned off (e.g., at the end of the exercise session). If so, then motor power is turned off and the brake is turned on in a step 428. Thereafter, the current values for pulley or sprocket position, motor current and torque are obtained in a step 432. The current and torque values are corrected for any base line errors in a step 436.

After the variables have been adjusted in Step 440, it is ascertained in a step 448 (FIG. 19) whether the motor and pulley or sprocket are in their expected position within a prescribed tolerance. If not, the system operation is halted in a step 452. If the expected motor and pulley positions are within the prescribed tolerance, it is then ascertained in a step 456 whether the motor and pulley are in the same position relative to each other. They will not be if the attachment of the pulley to the motor shaft has become loose, if there is a structural failure in the pulley or if there is a failure of either potentiometer 70 or optical encoder 108. If that is the case, then system operation is halted in a step 460. If all is well up to this point, it is then ascertained in a step 466 whether the pulley or sprocket is within the set stops within a prescribed tolerance. If not, then the pulley or sprocket was placed in a position outside the permitted range of motion, and the system operation is halted in a step 470. If the pulley or sprocket is within the set stops, it is then ascertained in a step 474 whether the motor and pulley or sprocket are calibrated within the prescribed tolerance (i.e., they are located in the same position). If not, then system operation is halted in a step 478. If the motor and pulley or sprocket are properly calibrated, then it is ascertained in a step 482 whether it has been an overly abrupt change in torque since the last time torque was checked. If so, then system operation is halted in a step 486. If not, then the system proceeds to process the input data to control motor 100 based on the present exercise mode.

The 100 hertz routine typically will not finish executing before the next 400 hertz interrupt. Nevertheless, the 400 hertz routine is given a higher priority. Thus, to avoid conflicts with the 400 hertz routine, the 100 hertz routine does not update the value of VELOUT400 until the 100 hertz routine has completed. In the meantime, the 100 hertz routine works with a prototype of VELOUT400 termed VELOUT.

It is first ascertained in a step 490 whether the system has been set in an idle state. If so, then VELOUT is set to zero in a step 494, and processing continues in a step 498 shown in FIG. 21. Step 498 limits VELOUT to the maximum machine velocity. Since VELOUT equaled zero in idle mode, this step has no affect on VELOUT. Thereafter, VELOUT is copied into VELOUT400 in a step 502, and the routine is exited in a step 506.

Figure 21:
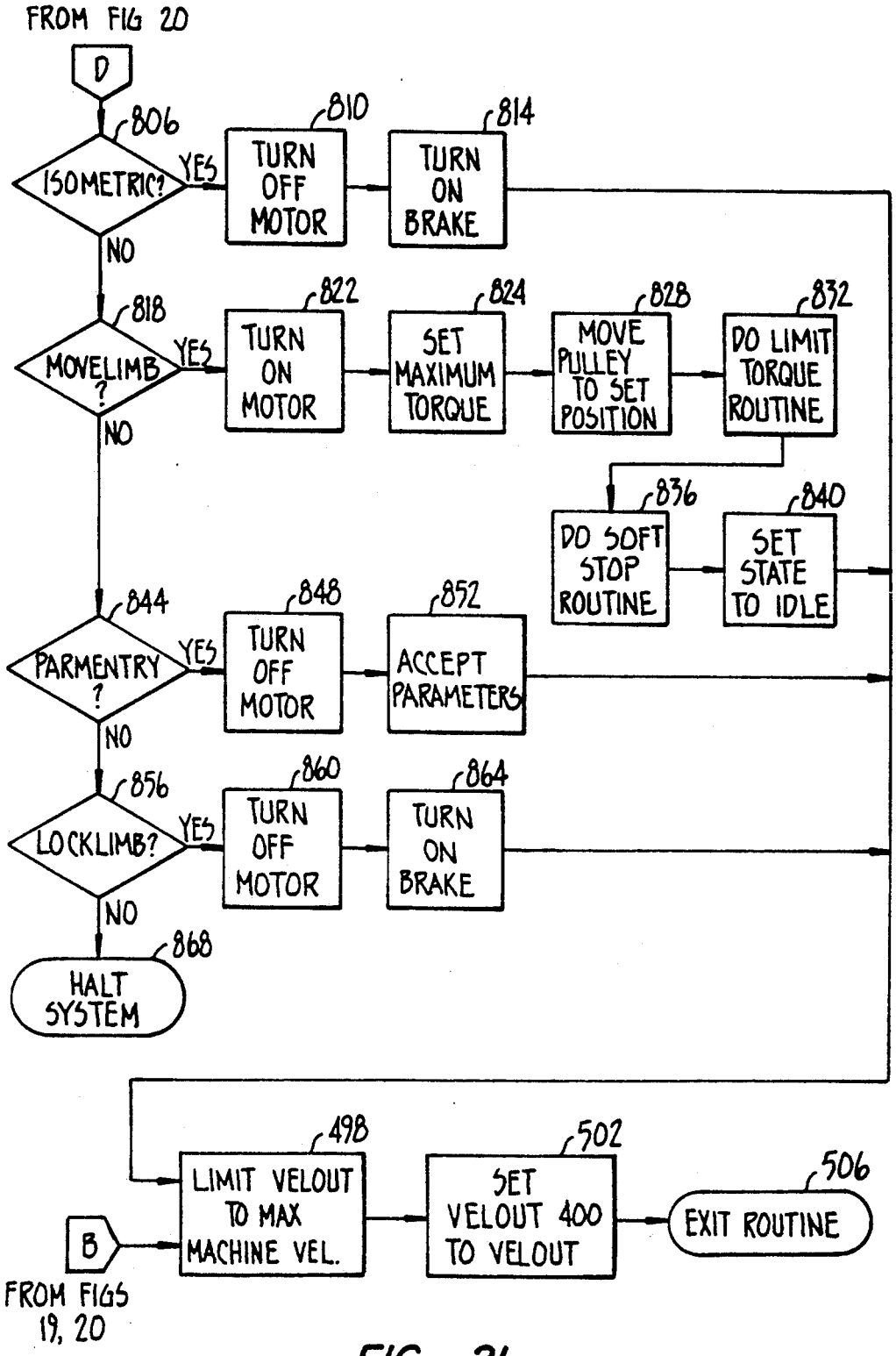

If the system is not set in an idle state, it is then ascertained in a step 510 (FIG. 19) whether the operator has requested to set the range of motion of the reciprocating members (i.e., set the stops). If so, then it is ascertained in a step 514 whether the system was set in a stop state the last time it was checked. If not, then the motor position is calibrated to the pulley position in a step 518, and motor power is turned on in a step 522. The stops are then set in a step 526. This is accomplished by moving the reciprocating member to a prescribed position using the cursor control keys on the computer and then storing the clockwise and counterclockwise stop positions. The stops are then limited to the maximum range of motion set for the machine in a step 530. This limitation ensures that the operator cannot set the reciprocating member range of motion beyond that which is reasonable or safe for the particular machine and patient. Once the stops have been set and properly limited, processing continues in step 498 (FIG. 21).

If the operator has not requested to set the stop, positions, then it is ascertained in a step 534 (FIG. 20) whether gravity compensation for the reciprocating members is to be performed. This is desirable after the orientation of the track has been changed or the motion of the reciprocating members changed between reciprocal and tandem. If gravity compensation is to be performed, then the system automatically moves the pulley or sprocket to the counterclockwise stop position in a step 538. Thereafter, the pulley or sprocket is moved clockwise in a step 542, and the torque value caused by the effect of gravity on the reciprocating member for the present position is stored in a table in a step 546. It is then ascertained in a step 550 whether the clockwise stop has been reached. If not, then the system continues moving the pulley or sprocket clockwise and storing corresponding torque values in the table until the clockwise stop is reached. Once the clockwise stop is reached, the pulley or sprocket is moved counterclockwise in a step 554, and a corresponding torque value for the present position is added to the table value previously stored for that position in a step 558. It is then ascertained in a step 562 whether the counterclockwise stop has been reached. If not, then the system continues moving the lever clockwise and adding corresponding torque values in the table until the clockwise stop,.is reached. Once the counterclockwise stop is reached in step 562, the motor is turned off in a step 566, and processing continues in step 498 (FIG. 21). When the gravity compensation routine is complete, a sum of two torque values for each pulley or sprocket position are stored in the table. The gravity compensation torque value then may be calculated as the average of the two values. Of course, summing and averaging could be done over more than two values if desired. The gravity compensation torque values are added to or subtracted from the sensed torque to ensure that the weight of the reciprocating members does not affect the patient's ability to use the system for its intended purpose and to ensure that the actual patient effort is monitored and controlled.

If gravity compensation is not to be performed at this time, it is then ascertained in a step 567 whether the acceleration table is to be created. The acceleration table is a position-addressed table which provides a position ramp factor derives from the desired acceleration parameter input by the operator. That is the table entries define a curve describing constant acceleration. If the acceleration table is to be created at this time, then the ramp factor for each position along the set range of motion is calculated in a step 568. To calculate each ramp factor, it is noted that from elementary physics $V(T)=AT$ and $P(T)=\frac{1}{2}AT^2$ where A is the acceleration parameter set by the operator. Then $T=\sqrt{2P/A}$ and $V=\sqrt{2AP}$. If we scale to 5 counts per deg/sec and to convert to a position ramp factor PR 1 count per 0.8 deg., V then PR=5 2A(0.8P) or PR=6.23456 AP. Thus, for each position P, a corresponding position ramp factor may be calculated from the set acceleration. The calculated ramp factors are stored in the acceleration table in a step 569, and processing continues in step 498 (FIG. 21).

If the acceleration table is not to be created at this time, it is then ascertained in a step 570 whether the system has been set in concentric/concentric mode. If so, then the currently set maximum torque value is stored in a step 574, and the motor is turned on in a step 578. The maximum torque value is used to ensure that the torque applied to the pulley or sprocket does not exceed the maximum torque set by the operator. If the patient attempts to exceed this maximum torque limit, then motor 100 accelerates the pulley or sprocket to ensure that the set torque maximum is not exceeded.

Figure 22:
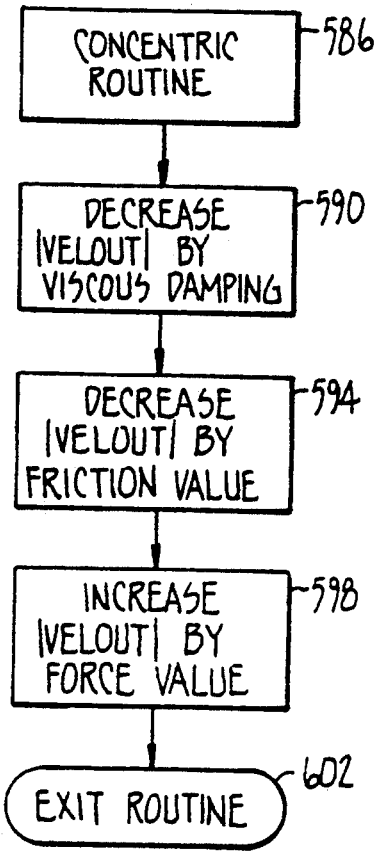

After the motor is turned on, a concentric motion routine is performed in a step 582. The concentric routine is entered in a step 586 (FIG. 22). The function of the concentric routine is to simulate a flywheel with viscous damping. Accordingly, the absolute value of VELOUT is decreased by a viscous damping factor (determined by the programmer) in a step 590, and then the absolute value of VELOUT is decreased by a desired friction value in a step 594. Thereafter, the absolute value of VELOUT is increased by the amount of torque applied by the patient in a step 598. The torque applied to the pulley or sprocket in its present position has been adjusted to compensate for gravity using the gravity compensation tables discussed above. The routine is then exited in a step 602.

Once VELOUT has been altered in the concentric routine, it is necessary to ensure that velocity and torque have not exceeded their prescribed limits, especially when a pulley or sprocket is nearing the clockwise or counterclockwise stop position. Thus, a limit velocity routine is first performed in a step 606, a limit torque routine is performed in a step 630, and a soft stop routine is performed in a step 658.

Figure 23:
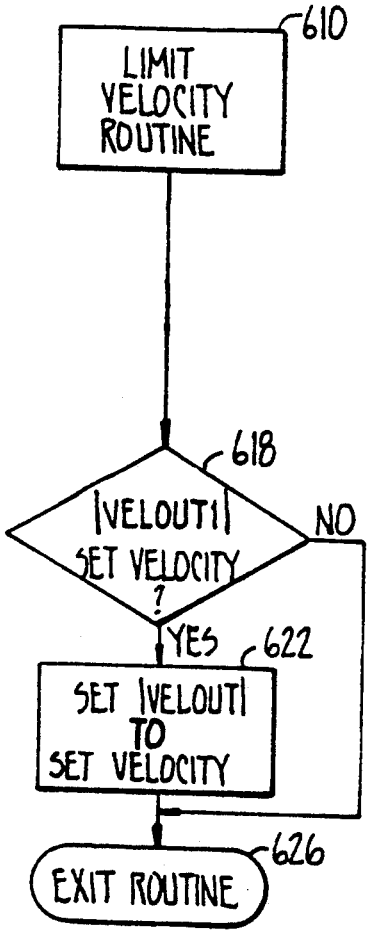

The limit velocity routine is entered in a step 610 (FIG. 23). It is then ascertained in a step 618 whether the absolute value of VELOUT is greater than the set velocity. If not, the routine is exited in a step 626. If so, then the absolute value of VELOUT is limited to the velocity in a step 622, and the routine is exited in step 626.

Figure 25:
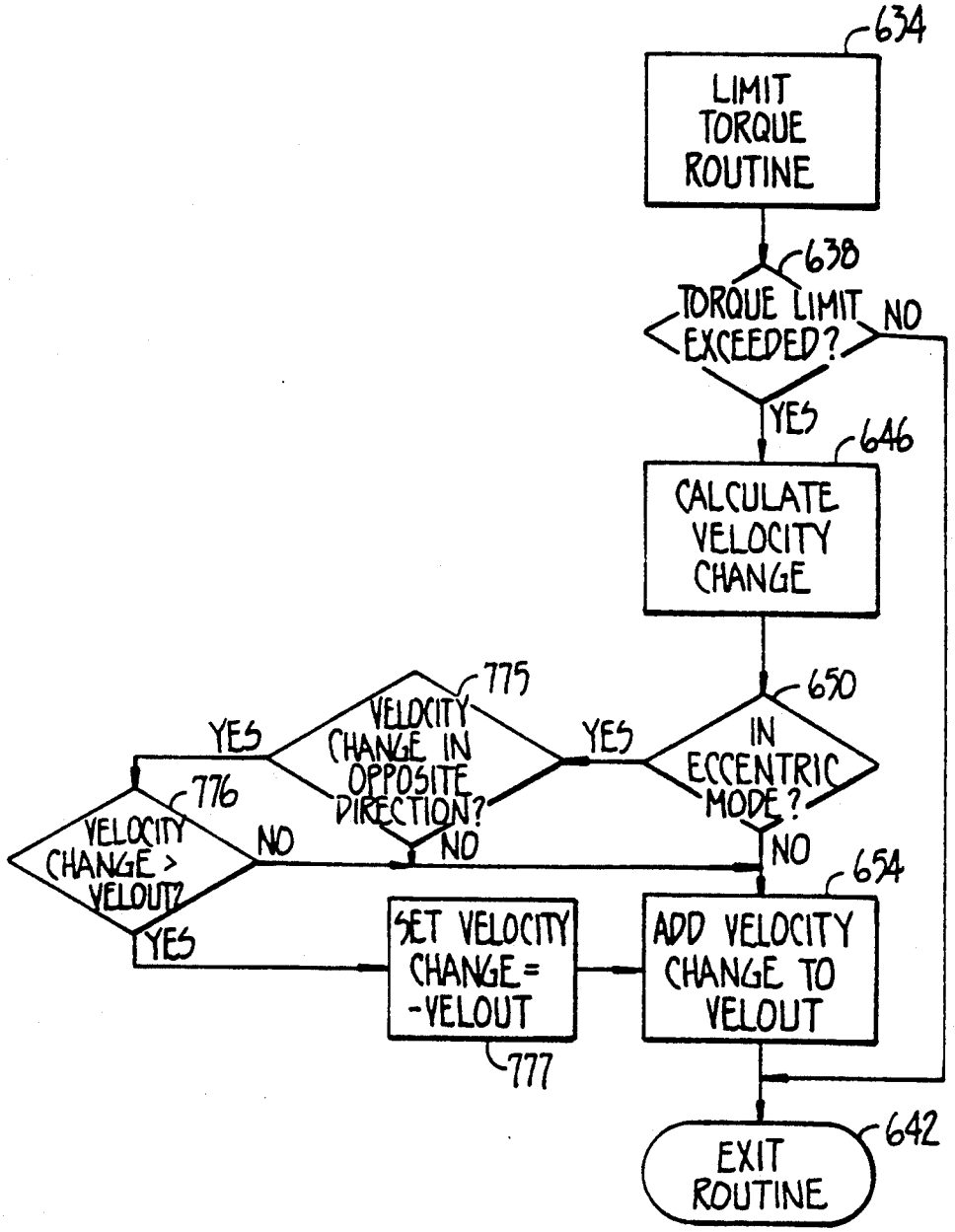

The limit torque routine is entered in a step 634 (FIG. 25). It is first ascertained in a step 638 whether the set maximum torque limit has been exceeded. If not, then the routine is exited in a step 642. If so, then the adjustment to VELOUT estimated to compensate for the excessive torque is calculated in a step 646. It is then ascertained in a step 650 whether the system is presently in eccentric mode. Since we are not in eccentric mode, then the calculated adjustment value is added to VELOUT in a step 654, and the routine is exited in step 642. It should be noted that an isotonic exercise mode may be added merely by executing the concentric exercise routine with a set velocity of zero and a nonzero torque limit.

Figure 24:
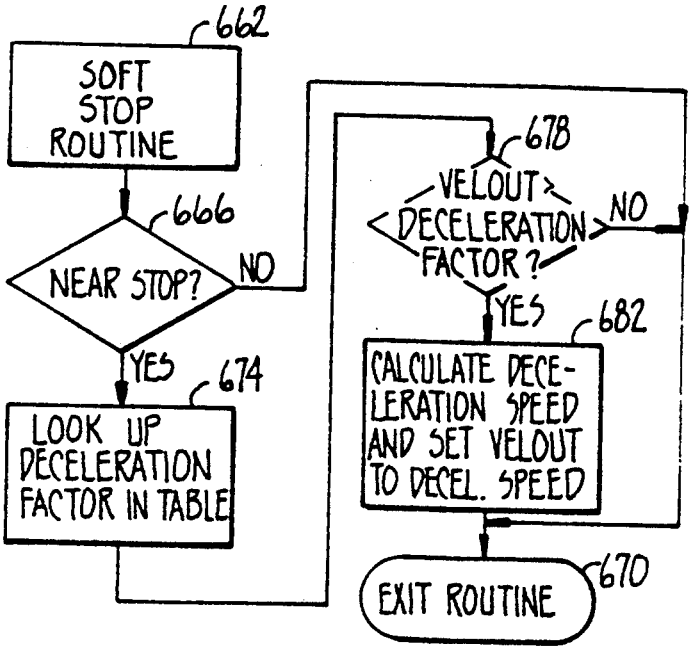

The soft stop routine is entered in a step 662 (FIG. 24). The soft stop routine ensures smooth acceleration from and deceleration to the clockwise and counterclockwise stops. Thus, it is first ascertained in a step 666 whether the pulley or sprocket is within a prescribed distance from the clockwise or counterclockwise stop positions. If not, then the routine is exited in a step 670. If so, then the system obtains a deceleration factor from a table in a step 674, and a deceleration speed is calculated from the deceleration factor. The deceleration factor table is addressed by the pulley or sprocket position. It is then ascertained in a step 678 whether the value of VELOUT is greater than the deceleration speed. If so, then VELOUT is set to the deceleration speed in a step 682, and the routine is exited in step 670.

After the soft stop routine is performed, processing continues in step 498 (FIG. 21).

If the system is not in concentric/concentric mode, it is then ascertained in a step 686 (FIG. 20) whether the system is in concentric/eccentric or eccentric/concentric mode. In these modes, the patient exerts force on the reciprocating member in one direction of motion, and the reciprocating member exerts force on the patient in the other direction of motion. As in concentric/-concentric mode, the maximum torque is set in a step 690, and the motor is turned on in a step 694. A CONECC routine is then performed in a step 698.

Figure 26:
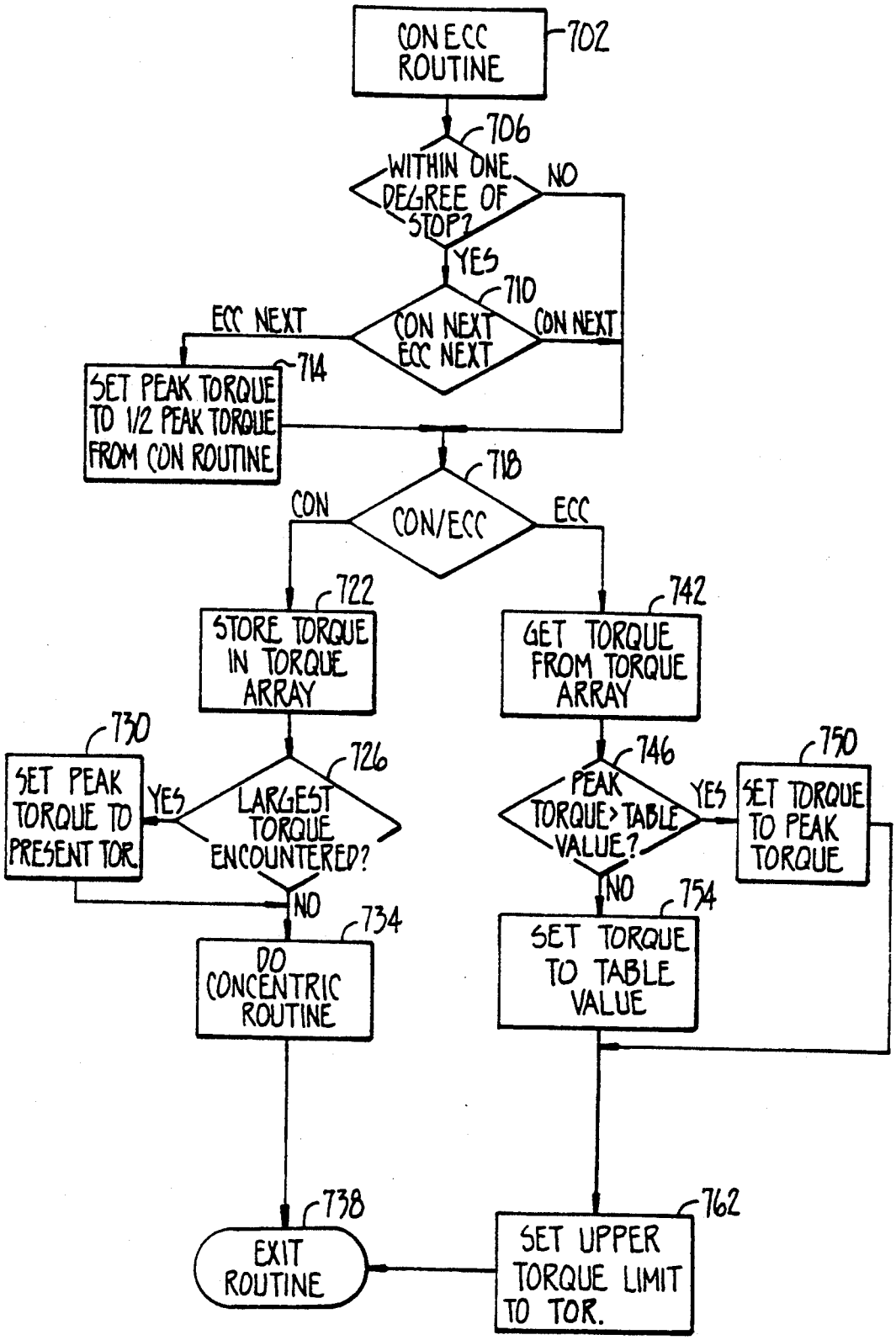

The CONECC routine begins in a step 702 (FIG. 26). The routine initially determines whether the pulley or sprocket is within a prescribed distance e.g., 1°, of either the clockwise or counterclockwise stop in a step 706. If so, then the system is to change from concentric mode to eccentric mode or vice versa, and it is ascertained in a step 710 which mode is to be performed next. If eccentric mode is to be performed next, then a peak torque value is set to one half the peak torque value obtained from the previous concentric phase of the routine in a step 714. This peak torque value is used to set the minimum force applied to the patient's limb by the reciprocating member in eccentric mode. The limb is thus exercised based upon the patient's actual performance rather than some theoretical force set by the operator. Thereafter, it is determined in a step 718 whether the system is now in concentric or eccentric mode. If the system is in concentric mode, then the current torque applied to the pulley or sprocket by the patient is stored in a torque array in a step 722, and it is ascertained in a step 726 whether this is the largest torque encountered in this set. If so, then the peak torque (used in eccentric mode as noted above) is set to the present torque in a step 730. If not, then the concentric routine is performed in a step 734. This concentric routine is the same concentric routine shown in FIG. 22. Once the concentric routine is finished, the routine is exited in a step 738.

If it is ascertained in step 718 that the system is in eccentric mode, then the present pulley or sprocket position is used in a step 742 to address the torque array that was filled the last time the system was in concentric mode. It is then ascertained in a step 746 whether the peak torque (equal to one half the peak torque encountered the last time the system was in concentric mode) is greater than the addressed torque array value. If so, then the torque to be applied by the pulley or sprocket to the patient is set to the peak torque value in a step 750; otherwise the pulley or sprocket torque is set to the value stored in the torque array in a step 754. Finally, the upper torque limit is set to the scaled torque value in a step 762.

The net effect of these torque calculations is that the torque applied to the pulley or sprocket by the patient during the last concentric phase is used as a basis for the torque applied to the patient's limb during the eccentric phase, with a minimum torque equal to one half the peak torque encountered during the concentric phase. If the patient is able to resist the reciprocating member with greater torque than the selected torque value, then the torque will be limited by the set upper torque limit.

After the CONECC routine is performed, the limit velocity routine is performed in a step 766, the limit torque routine is performed in a step 770, and the soft stop routine is performed in a step 774. These routines are essentially the same as those shown in FIGS. 23, 25, and 24, respectively. The only difference is that, in the limit torque routine (FIG. 25), the execution path changes slightly at step 650 when the system is in eccentric mode. In this case it is then ascertained in a step 775 whether the calculated velocity change will operate to decrease VELOUT. If not, then processing continues in step 654. If so, then it is ascertained in a step 776 whether the calculated velocity change is greater than the current value of VELOUT. If not, then processing continues in step 654. If so, then the velocity change is set to −VELOUT in a step 777, and processing continues in step 654. The net effect of these calculations is to allow the patient to slow down the reciprocating member or stop it, but to prevent the patient from reversing direction of rotation.

If the system is not in one of the concentric/eccentric or eccentric/concentric modes, then it is ascertained in a step 778 (FIG. 20) whether the system is in CPM mode. If so, then the maximum torque is set in a step 782, and the motor is turned on in a step 786. VELOUT is then set to the maximum velocity set by the operator in a step 790 since it is presumed that the patient will not be pushing on the reciprocating member or resisting the reciprocating member motion. Nevertheless, the limit velocity routine is performed in a step 794, the limit torque routine is performed in a step 798, and the soft stop routine is performed in a step 802 to ensure that the velocity of and torque applied to the pulley or sprocket are in fact within the proper limits. After the soft stop routine is performed in step 802, processing continues in step 498 (FIG. 21).

If the system is not in CPM mode, it is then ascertained in a step 806 (FIG. 21) whether the system is to effect an isometric exercise. If so, then the motor is turned off in a step 810, and the motor brake is turned on in a step 814. Of course, VELOUT is set to 0 in this case. Processing then continues in step 498.

If the system is not effecting an isometric exercise, then it is determined in a step 818 whether the system is in a move limb state. In this state, the reciprocating member moves to a position indicated by the operator. Thus, the motor is turned on in a step 822, and the maximum torque is set in a step 824. Thereafter, the reciprocating member (and the patient's limb) is moved to the desired position in a step 828. The velocity used in this mode is set by the programmer or may be entered manually. Thereafter, the limit torque routine is performed in a step 832, and the soft stop routine is performed in a step 836. Once the desired position is reached, the state is set to idle in a step 840, and processing continues in step 98.

If the system is not in a move limb state, it is then ascertained in a step 844 whether the system is in a parameter entry state. If so, then the motor is turned off in a step 848, and parameters entered by the operator are accepted by the system in a step 852. Processing then continues in step 498.

If the system is not in a parameter entry state, it is then ascertained in a step 856 whether the system is in a lock limb state. If so, the motor is turned off in a step 860 and the brake is turned on in a step 864. Processing then continues in step 498.

If the system is not in a lock limb state, then a system error exists, and the system is halted in a step 868.

While the above is a complete description of a preferred embodiment of the present invention, various modifications may be employed.

The teachings of the present invention also could be applied to velocity-based systems wherein the position signal is differentiated to produce a velocity signal. In this embodiment, the velocity of the shaft may be successively increased using velocity increments, tabled velocity value, or some other convenient means. Consequently, the scope of the invention should not be limited except as described in the claims.

What is claimed is:

1. An exercise apparatus comprising:

a base;

a guide supported on the base, the guide having an axis;

a first reciprocating member coupled to the guide for motion in the direction of the axis;

a second reciprocating member coupled to the guide for motion in the direction of the axis;

motion constraining means for constraining the motion of at least one of the reciprocating members;

force measuring means for independently measuring the force applied to each of the reciprocating members; and display means for displaying information about an exercise session to the user, said information including the force independently applied to each reciprocating member.

2. An exercise apparatus according to claim 1 wherein the motion constraining means includes isokinetic means for constraining the motion of at least one of the reciprocating members to be isokinetic.

3. The apparatus according to claim 2 wherein the motion constraining means further comprising:

reciprocal motion means for constraining the motion of the reciprocating members with respect to each other to be reciprocal; and tandem motion means for constraining the motion of the reciprocating members with respect to each other to be tandem.

4. An exercise apparatus according to claim 1 wherein the motion constraining means includes isotonic means for constraining the motion of at least one of the reciprocating members to be isotonic.

5. The apparatus according to claim 4 wherein the motion constraining means further comprising:

reciprocal means for constraining the motion of the reciprocating members with respect to each other to be reciprocal; and tandem motion means for constraining the motion of the reciprocating members with respect to each other to be tandem.

6. An exercise apparatus according to claim 1 wherein the motion constraining means includes constant rate of change means for constraining the motion of at least one of the reciprocating members to be at a constant rate of change of velocity.

7. The apparatus according to claim 6 wherein the motion constraining means further comprising:

reciprocal motion means for constraining the motion of the reciprocating members with respect to each other to be reciprocal; and tandem motion means for constraining the motion of the reciprocating members with respect to each other to be tandem.

8. The exercise apparatus according to claim 1 wherein the motion constraining means includes:

isokinetic means for constraining the motion of at least one of the reciprocating members to be isokinetic;

isotonic means for constraining the motion of at least one of the reciprocating members to be isotonic; and constant rate of change means for constraining the motion of at least one of the reciprocating members to be at a constant rate of change of velocity.

9. The apparatus according to claim 8 wherein the motion constraining means further comprising:

reciprocal motion means for constraining the motion of the reciprocating members with respect to each other to be reciprocal; and tandem motion means for constraining the motion of the reciprocating members with respect to each other to be tandem.

10. The apparatus according to claim 1 wherein the display means includes means for providing a printed report of at least some of the information displayed.

11. The apparatus according to claim 1 wherein the force measuring means comprises at least one strain gauge.

12. The apparatus according to claim 11 wherein the at least one strain gauge is mounted on the reciprocating members.

13. The apparatus according to claim 1 further comprising:

horizontal positioning means for position said guide in a substantially horizontal position relative to the base; and vertical positioning means for positioning said guide in a substantially vertical position relative to the base.

14. The apparatus according to claim 13 wherein the motion constraining mans further comprising:

reciprocal motion means for constraining the motion of the reciprocating members with respect to each other to be reciprocal; and tandem motion means for constraining the motion of the reciprocating members with respect to each other to be tandem.

15. The apparatus according to claim 1 wherein the motion constraining mans comprising:

reciprocal motion means for constraining the motion of the reciprocating members with respect to each other to be reciprocal; and tandem motion means for constraining the motion of the reciprocating members with respect to each other to be tandem.

16. An exercise apparatus comprising:

a base for placing the exercise apparatus on a surface;

a horizontally extending guide coupled to the base, the guide having a horizontally extending axis;

a first reciprocating member coupled to the guide for motion in the direction of the axis;

a second reciprocating member coupled to the guide for motion in the direction of the axis;

control means for selectively controlling the motion of the reciprocating members with respect to each other between a reciprocal motion and a tandem motion; and position selecting means for selectively positioning said guide between first and second position relative to the base.

17. The apparatus according to claim 16 wherein the first position is substantially horizontal and the second position is substantially vertical.

18. The apparatus according to claim 17 wherein the control means comprising:

motion constraining means for constraining the motion of at least one of the reciprocating members to be at a constant rate of change of velocity.

19. The apparatus according to claim 18 wherein the motion constraining means comprising:

reciprocal motion means for constraining the motion of the reciprocating members with respect to each other to be reciprocal; and tandem motion means for constraining the motion of the reciprocating members with respect to each other to be tandem.

20. The apparatus according to claim 17 wherein the control means comprising:

reciprocal motion means for constraining the motion of the reciprocating members with respect to each other to be reciprocal; and tandem motion means for constraining the motion of the reciprocating members with respect to each other to be tandem.

21. The apparatus according to claim 17 wherein the control means comprising:

isokinetic means for constraining the motion of at least one of the reciprocating members to be isokinetic.

22. The apparatus according to claim 17 wherein the control means further comprising:

reciprocal motion means for constraining the motion of the reciprocating members with respect to each other to be reciprocal; and tandem motion means for constraining the motion of the reciprocating members with respect to each other to be tandem.

23. The apparatus according to claim 17 wherein the control means comprising:

isotonic means for constraining the motion of at least one of the reciprocating members to be isokinetic.

24. The apparatus according to claim 23 wherein the control means further comprising:

reciprocal motion means for constraining the motion of the reciprocating members with respect to each other to be reciprocal; and tandem motion means for constraining the motion of the reciprocating members with respect to each other to be tandem.

25. The apparatus according to claim 17 wherein the control means comprising:

isokinetic means for constraining the motion of at least one of the reciprocating members to be isokinetic;

isotonic means for constraining the motion of at least one of the reciprocating members to be isotonic; and constant rate of change means for constraining the motion of at least one of the reciprocating members to be at a constant rate of change of velocity.

26. The apparatus according to claim 17 wherein the control means further comprising:

reciprocal motion means for constraining the motion of the reciprocating members with respect to each other to be reciprocal; and tandem motion means for constraining the motion of the reciprocating members with respect to each other to be tandem.

27. The apparatus according to claim 17 wherein the guide is pivotally coupled to the base for pivoting the guide from the first position to the second position.

28. The apparatus according to claim 17 wherein a first end of the guide is pivotally coupled to a first end of the base for pivoting the guide from the first position to the second position.

29. The apparatus according to claim 28 further comprising:

a releasable joint for releasably coupling a second end of the guide to a second end of the base when the guide is disposed in the generally horizontal position.

30. An exercise apparatus comprising:

a horizontally extending guide having a horizontally extending axis;

a first reciprocating member coupled to the guide for linear motion in the direction of the axis;

a second reciprocating member coupled to the guide for linear motion in the direction of the axis;

control means including motion constraining means for constraining the linear motion of at least one of the reciprocating members to be at a constant rate of change of velocity.

31. The apparatus according to claim 30 wherein the motion constraining means comprising:

reciprocal motion means for constraining the motion of the reciprocating members with respect to each other to be reciprocal; and tandem motion means for constraining the motion of the reciprocating members with respect to each other to be tandem.

32. An exercise apparatus comprising:

a base;

a horizontally extending guide supported on the base, the guide having a horizontally extending axis;

a first reciprocating member coupled to the guide for motion in the direction of the axis, the first reciprocating member being shaped for receiving a first limb of a user;

a second reciprocating member coupled to the guide for motion in the direction of the axis, the second reciprocating member being shaped for receiving a second limb of a user;

a seat disposed adjacent the guide for seating a user in a position facing the first and second reciprocating members; and control mans for selectively controlling the motion of the reciprocating members with respect to each other between a reciprocal motion and a tandem motion, wherein said control means comprising reciprocal motion means for constraining the motion of the reciprocating members with respect to each other to be reciprocal and tandem motion means for constraining the motion of the reciprocating members with respect to each other to be tandem.

33. An exercise apparatus comprising:

a base;

a horizontally extending guide supported on the base, the guide having a horizontally extending axis;

a first reciprocating member coupled to the guide for motion in the direction of the axis;

a second reciprocating member coupled to the guide for motion in the direction of the axis;

control means for selectively controlling the motion of the reciprocating members, wherein said control means comprising reciprocal motion means for constraining the motion of the reciprocating members with respect to each other to be reciprocal;

tandem motion means for constraining the motion of the reciprocating members with respect to each other to be tandem;

isokinetic means for constraining the motion of at least one of the reciprocating members to be isokinetic;

isotonic means for constraining the motion of at least one of the reciprocating members to be isotonic; and constant rate of change means for constraining the motion of at least one of the reciprocating members to be at a constant rate of change of velocity;

force measuring means for measuring the force applied to each of the reciprocating members;

means for displaying information about an exercise session to the user, said information including the force applied to each reciprocating member, the display means including means for providing a printed report of at least some of the information displayed; and position selecting means for selectively positioning said guide in a substantially horizontal position and for selectively positioning said guide in a substantially vertical position.

* * * * *